US005574550A

United States Patent [19]

Okazaki et al.

[11] Patent Number: 5,574,550

[45] Date of Patent: Nov. 12, 1996

[54] TRANSFER DEVICE FOR IMAGE FORMING MACHINE

[75] Inventors: Noritaka Okazaki; Ryuji Wataki; Michio Uchida; Shigeo Fujita; Yuzuru Nanjo, all of Osaka, Japan

[73] Assignee: Mita Industrial Co., Ltd., Osaka, Japan

[21] Appl. No.: 542,961

[22] Filed: Oct. 13, 1995

[30] Foreign Application Priority Data

Nov. 10, 1994 [JP] Japan ..... 6-300129
Nov. 10, 1994 [JP] Japan ..... 6-300130

[51] Int. Cl.[6] ..... G03G 15/14

[52] U.S. Cl. ..... 399/313

[58] Field of Search ..... 355/271, 274, 355/275, 277

[56] References Cited

U.S. PATENT DOCUMENTS 4,407,580 10/1983 Hashimoto et al. ..... 355/275
5,172,173 12/1992 Goto et al. ..... 355/275
5,287,152 2/1994 Oka et al. ..... 355/274
5,469,248 11/1995 Fujiwara et al. ..... 355/271 X

*Primary Examiner*—Robert Beatty
*Attorney, Agent, or Firm*—Antonelli, Terry, Stout & Kraus

[57] ABSTRACT

A transfer device for an image forming machine has a driving roller, a driven roller disposed at a distance from the driving roller, a transfer belt extending between the driving roller and the driven roller, a transfer roller disposed opposite an image bearing member, with the transfer belt interposed therebetween and pressing the transfer belt against the image bearing member, and a voltage source for applying a predetermined voltage onto the transfer roller. The transfer roller consists of a rotating shaft and a roller portion mounted on the rotating shaft, and the hardness of the roller portion is set to result in a compression of 0.45 to 2.00 mm at a linear pressure of 3 g/cm. The volume resistivity of the roller portion of the transfer roller is set at $10^2$ to $10^9$ ohm-centimeters.

3 Claims, 32 Drawing Sheets

Image densities relative to transfer voltages according to volume resistivities of transfer rollers in L/L environment (volume resistivity of transfer belt : $10^{11}\Omega$ cm)

Image densities relative to transfer voltages according to volume resistivities of transfer rollers in N/N environment (volume resistivity of transfer belt : $10^{11}\Omega$ cm)

Image densities relative to transfer voltages according to volume resistivities of transfer rollers in H/H environment (volume resistivity of transfer belt : $10^{11}\Omega$ cm)

United States Patent Office

PTO - BOYERS, PA Duty Station

MISSING PAGE TEMPORARY NOTICE

PATENT # 5,574,550 FOR ISSUE DATE 11-12-1996 HAS BEEN SCANNED, BUT WITH MISSING PAGE(S). UPON RECEIVING OF MISSING PAGE(S), THE ENTIRE DOCUMENT WILL BE RESCANNED. PLEASE CALL THE OFFICE OF DATA BASE ADMINISTRATION AT (703) 308-0555 IF YOU HAVE A QUESTION.

THIS NOTICE IS FOR THE MISSING PAGE CONTAINING:

DRW Pg 24 of 32

Data Conversion Operation

Boyers, Pa

Image densities relative to transfer voltages according to volume resistivities of transfer rollers in N/N environment (volume resistivity of transfer belt : $10^{11}\Omega$ cm)

Image densities relative to transfer voltages according to volume resistivities of transfer rollers in H/H environment (volume resistivity of transfer belt : $10^{11}\Omega$ cm)

Image densities relative to transfer voltages according to volume resistivities of transfer rollers in L/L environment (volume resistivity of transfer belt : $10^{11}\Omega$ cm)

Image densities relative to transfer voltages according to volume resistivities of transfer rollers in N/N environment (volume resistivity of transfer belt : $10^{11}\Omega$ cm)

Image densities relative to transfer voltages according to volume resistivities of transfer rollers in H/H environment (volume resistivity of transfer belt : $10^{11}\Omega$ cm)

Image densities relative to transfer voltages according to volume resistivities of transfer rollers in L/L environment (volume resistivity of transfer belt : $10^{11}\Omega$ cm)

Image densities relative to transfer voltages according to volume resistivities of transfer rollers in N/N environment (volume resistivity of transfer belt : $10^{11}\Omega$ cm)

Image densities relative to transfer voltages according to volume resistivities of transfer rollers in H/H environment (volume resistivity of transfer belt : $10^{11}\Omega$ cm)

TRANSFER DEVICE FOR IMAGE FORMING MACHINE

FIELD OF THE INVENTION

This invention relates to a transfer device to be mounted on an image forming machine such as an electrophotographic apparatus or an electrostatic recording apparatus. More specifically, it relates to a transfer device of an image forming machine which transfers onto a transfer paper a toner image formed on an image bearing member, and conveys the transfer paper with the toner image transferred onto it.

DESCRIPTION OF THE PRIOR ART

This type of image forming machine generally adopts a corona discharge-based transfer system for transferring onto a transfer paper a toner image formed on an image bearing member. However, this corona discharge-based transfer system is poor in transfer properties at a high humidity, and tends to cause defective transfer due to dirt on the corona wire and wrinkles in the transfer paper. As a solution to these problems, Japanese Laid-Open Patent Publication No. Hei 4-345183, for instance, discloses a transfer system which has a transfer belt unit disposed opposite an image bearing member, the transfer belt unit comprising a driving roller, a driven roller disposed at a distance from the driving roller, a transfer belt looped between the driving roller and the driven roller, and a transfer roller disposed opposite the image bearing member with the transfer belt interposed therebetween. The transfer system applies a high voltage to the transfer roller to charge the transfer belt, thereby sequentially attracting and transferring a toner image, formed on the surface of the image bearing member, to transfer papers fed between the image bearing member and the transfer belt. In a transfer device with such a transfer system, the transfer belt is formed of a semiconductive material, such as polychloroprene, which has a volume resistivity of about $10^8$ to $10^{13}$ ohm centimeters. The transfer roller, on the other hand, is composed of a conductive material such as a metal, because it is intended for use as a power supply for applying a predetermined charge to the transfer belt.

With the above-described transfer system, a voltage can be applied at the transfer point, and the transfer paper is sandwiched between the image bearing member and the transfer roller via the transfer belt. Thus, disorder of the image when transferred is minimal, and a satisfactory image transferred is obtained.

In accordance with the transfer system that disposes the transfer roller opposite the image bearing member via the transfer belt and applies a voltage to the transfer roller, the pressure at the transfer point is high, posing no problems when an ordinary transfer paper is used. For a film for an overhead projector (OHP) or the like, to which a toner adheres with difficultly, however, a partial missing phenomenon is likely to occur in which the middle of the line of the image remains on the image bearing member without being transferred to the film.

Our experiments on such conventional transfer devices have shown that the transfer density considerably varies with environmental changes, such as temperature and humidity changes, and the appropriate transfer voltage also varies according to the environmental conditions. Hence, by controlling the voltage to be applied to the transfer roller in accordance with the environmental conditions, it has been found that desired transfer densities within a considerable range can be obtained. However, controlling the voltage to be applied to the transfer roller in accordance with the environmental conditions requires a temperature sensor, a humidity sensor, and a controller for controlling the applied voltage based on detection signals from these sensors, thus making the entire device expensive.

SUMMARY OF THE INVENTION

A first object of the present invention is to provide a transfer device capable of reliably transferring a toner image onto a transfer paper, to which a toner adheres with difficultly, by regulating the hardness of the transfer roller to fall within an appropriate range.

A second object of the present invention is to provide a transfer device capable of obtaining a predetermined transfer density, without controlling the voltage to be applied to the transfer roller in accordance with the environmental conditions, by regulating the volume resistivity of the transfer roller to fall within an appropriate range.

To attain the first object, a first aspect of the present invention provides a transfer device for an image forming machine, which has a driving roller, a driven roller disposed at a distance from the driving roller, a transfer belt looped between the driving roller and the driven roller, a transfer roller disposed opposite an image bearing member with the transfer belt interposed therebetween press the transfer belt against the image bearing member, and a voltage applying means for applying a predetermined voltage onto the transfer roller, and which transfers a toner image, formed on the surface of the image bearing member, to a transfer paper fed between the transfer belt and the image bearing member, and conveys the transfer paper with the toner image transferred onto it; wherein the transfer roller consists of a rotating shaft and a roller portion mounted on the rotating shaft, and the hardness of the roller portion is set to result in a compression of 0.45 to 2.00 mm at a linear pressure of 3 g/cm.

With the transfer device of an image forming machine according to the present invention, the transfer roller consists of the rotating shaft and the roller portion mounted on the rotating shaft, and the hardness of the roller portion is set to result in a compression of 0.45 to 2.00 mm at a linear pressure of 3 g/cm. Thus, even when the roller portion of the transfer roller is pressed against the image bearing member at the time of transfer, the pressure at the transfer point is not high. Accordingly, the partial missing phenomenon does not occur on a transfer paper to which the toner adheres with difficultly. Moreover, the durability of the transfer device is ensured.

To attain the second object, a second aspect of the present invention provides a transfer device for an image forming machine, which has a driving roller, a driven roller disposed at a distance from the driving roller, a transfer belt looped between the driving roller and the driven roller, a transfer roller disposed opposite an image bearing member with the transfer belt interposed therebetween to press the transfer belt against the image bearing member, and a voltage applying means for applying a predetermined voltage onto the transfer roller, and which transfers a toner image, formed on the surface of the image bearing member, to a transfer paper fed between the transfer belt and the image bearing member, and conveys the transfer paper with the toner image transferred onto it; wherein the transfer roller consists of a rotating shaft and a roller portion mounted on the rotating shaft, and the volume resistivity of the roller portion is set at $10^2$ to $10^9$ ohm centimeters.

the volume resistivity of the roller portion of the transfer roller being measured by placing the transfer roller, which comprises a roller member mounted on a roller shaft made of a conductive metal, on a base made of a conductive metal, applying a predetermined voltage between the roller shaft and the base with the roller member being compressed by 0.5 mm under a load imposed on the opposite end portions of the roller shaft, and measuring an electric current flowing between the roller shaft and the base to determine the electrical resistance between the roller shaft and the base, which represents the volume resistivity.

With the transfer device for an image forming machine according to the present invention, the transfer roller is composed of the rotating shaft and the roller portion mounted on the rotating shaft, and the volume resistivity of the roller portion is set at $10^2$ to $10^9$ ohm centimeters. Thus, by setting a transfer voltage in a safely usable range that is suitable for the volume resistivity of the transfer roller selected, a predetermined image density can be obtained without the need to control the transfer voltage in accordance with the environmental conditions. Other objects and features of the present invention will become apparent from the following description.

DETAILED DESCRIPTION OF THE PREFERRED EMBODIMENTS

Preferred embodiments of the transfer device for an image forming machine constructed in accordance with the present invention will be described in detail below with reference to the accompanying drawings.

Figure 1:
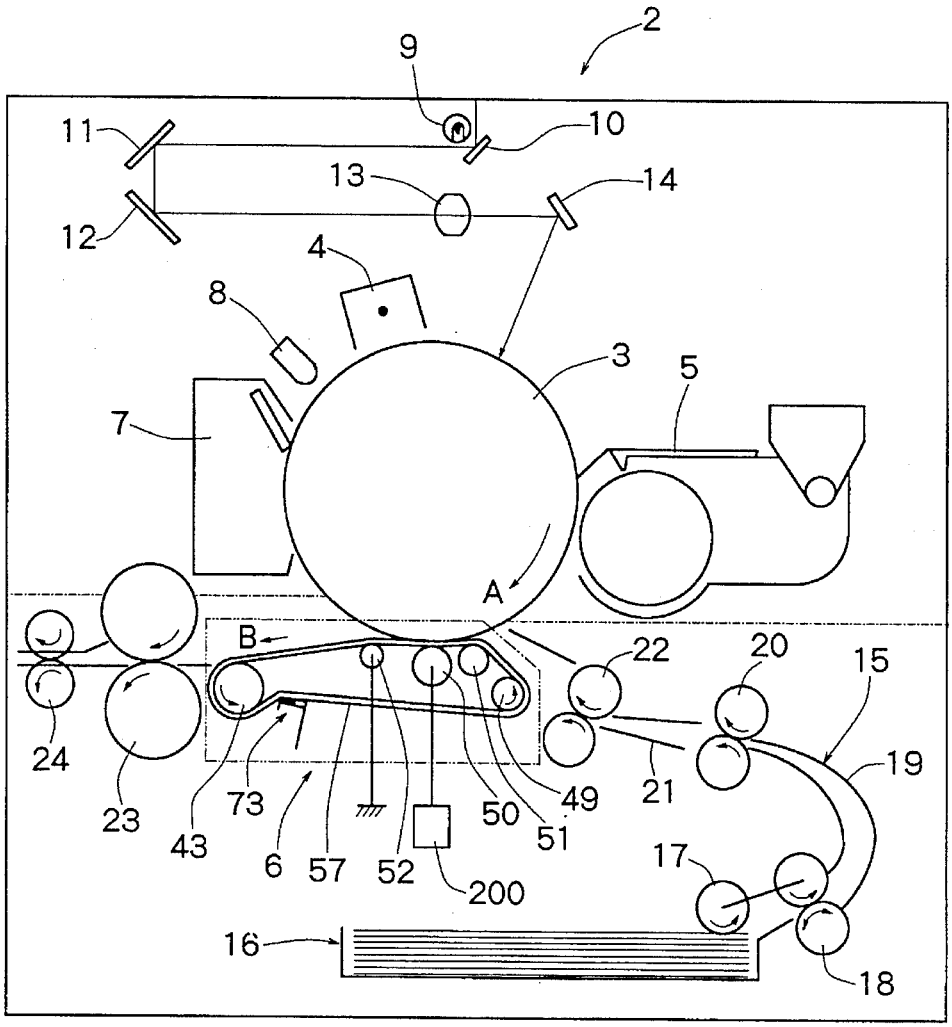
FIG. 1 is an abridged structural view showing an embodiment of an image forming machine equipped with a transfer device constructed in accordance with the present invention.
Figure 2:
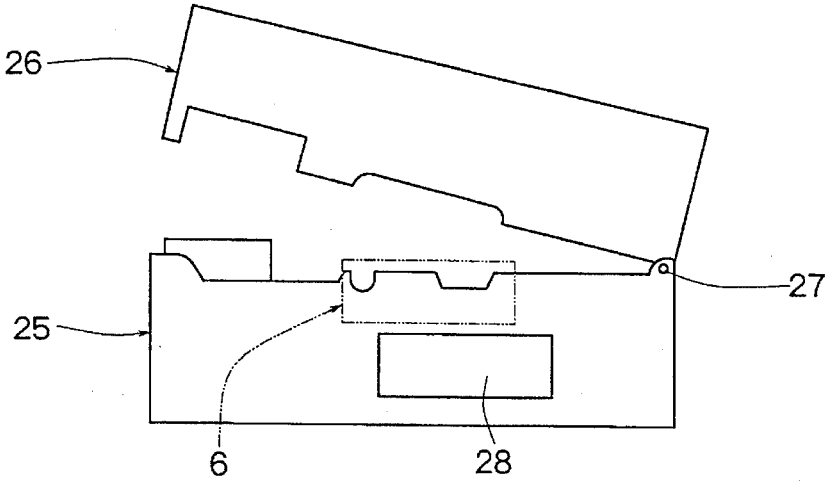
FIG. 2 is a front view of an image forming machine of a clamshell type equipped with a transfer device constructed in accordance with the present invention.

FIG. 1 is an abridged structural view showing an embodiment of an image forming machine equipped with a transfer device constructed in accordance with the present invention. FIG. 2 is a front view of an image forming machine equipped with the transfer device of the present invention.

An image forming machine 2 shown in FIG. 1 has an image bearing member 3 comprising a photosensitive drum mounted rotatably therein. Around the image bearing member 3 are disposed sequentially, as viewed in the direction of rotation indicated by arrow A, a charging corona discharger 4, a developing device 5, a transfer device 6 constructed in accordance with the present invention, a cleaning unit 7, and a destaticizing lamp 8. The illustrated image forming machine 2 has an optical system disposed above the image bearing member 3 and composed of an illuminating lamp 9, a first mirror 10, a second mirror 11, a third mirror 12, a lens 13, and a fourth mirror 14. This optical system is adapted to cast light on a document, placed on a document bearing transparent panel (not shown), by way of the illuminating lamp 9, and to focus an image of reflected light on the image bearing member 3 via the first mirror 10, second mirror 11, third mirror 12, lens 13, and fourth mirror 14. The image forming machine 2 has a transfer paper feeder 15 for feeding a transfer paper to the transfer device 6. The transfer paper feeder 15 has a transfer paper cassette 16 for accommodating transfer papers, a transfer paper delivery roller 17, a paper feed roller pair 18, a guide passage 19, a carriage roller pair 20, a guide passage 21, and a resist roller pair 22. On the transfer paper feed-off side of the transfer device 6 are disposed a fixing roller pair 23 and a discharge roller pair 24. In the thus constituted image forming machine, the respective members located below the one-dot chain line in FIG. 1 are disposed in a lower housing 25, constituting a machine body housing of a clamshell type shown in FIG. 2, while the respective members located above the one-dot chain line in FIG. 1 are disposed in an upper housing 26. The upper housing 26 has its right-hand lower end mounted by a shaft 27 on the lower housing 25 so as to be free to pivot, as shown in FIG. 2. The transfer device 6 is disposed at a central portion of the lower housing 25, as shown by a two-dot chain line in FIG. 2. The front plate of the lower housing 25 is provided with an opening 28 for mounting the transfer paper cassette 16.

The image forming machine 2 constructed as above works in the following manner: While the image bearing member 3 is being rotationally driven in the direction of arrow A, the charging corona discharger 4 charges the photosensitive material on the image bearing member 3 to a specific polarity substantially uniformly. Then, the illuminating lamp 9 illuminates a document placed on the document bearing transparent panel (not shown). An image of reflected light therefrom is projected onto the image bearing member 3 via the first mirror 10, second mirror 11, third mirror 12, lens 13 and fourth mirror 14, thereby forming a latent electrostatic image on the image bearing member 3. Then, the latent electrostatic image on the image bearing member 3 is developed to a toner image by the developing device 5. Separately, a transfer paper housed in the transfer paper cassette 16 of the transfer paper feeder 15 is delivered by the transfer paper delivery roller 17, and conveyed to the transfer device 6 past the paper feed roller pair 18, the guide passage 19, the carriage roller pair 20, the guide passage 21, and the resist roller pair 22. The transfer paper conveyed to the transfer device 6 is passed between the image bearing member 3, having the toner image formed thereon, and a transfer belt (to be described later) of the transfer device 6, whereby the toner image is transferred onto the transfer paper. Then, the transfer paper has the toner image fixed by the fixing roller pair 23 and is discharged by the discharge roller pair 24. The image bearing member 3 having a transfer step completed in this manner is cleared of the toner, adhered onto the surface of the photosensitive material, by means of the cleaning unit 7. Further, the surface of the photosensitive material is irradiated with destaticizing light by the destaticizing lamp 8 for static elimination.

Figure 3:
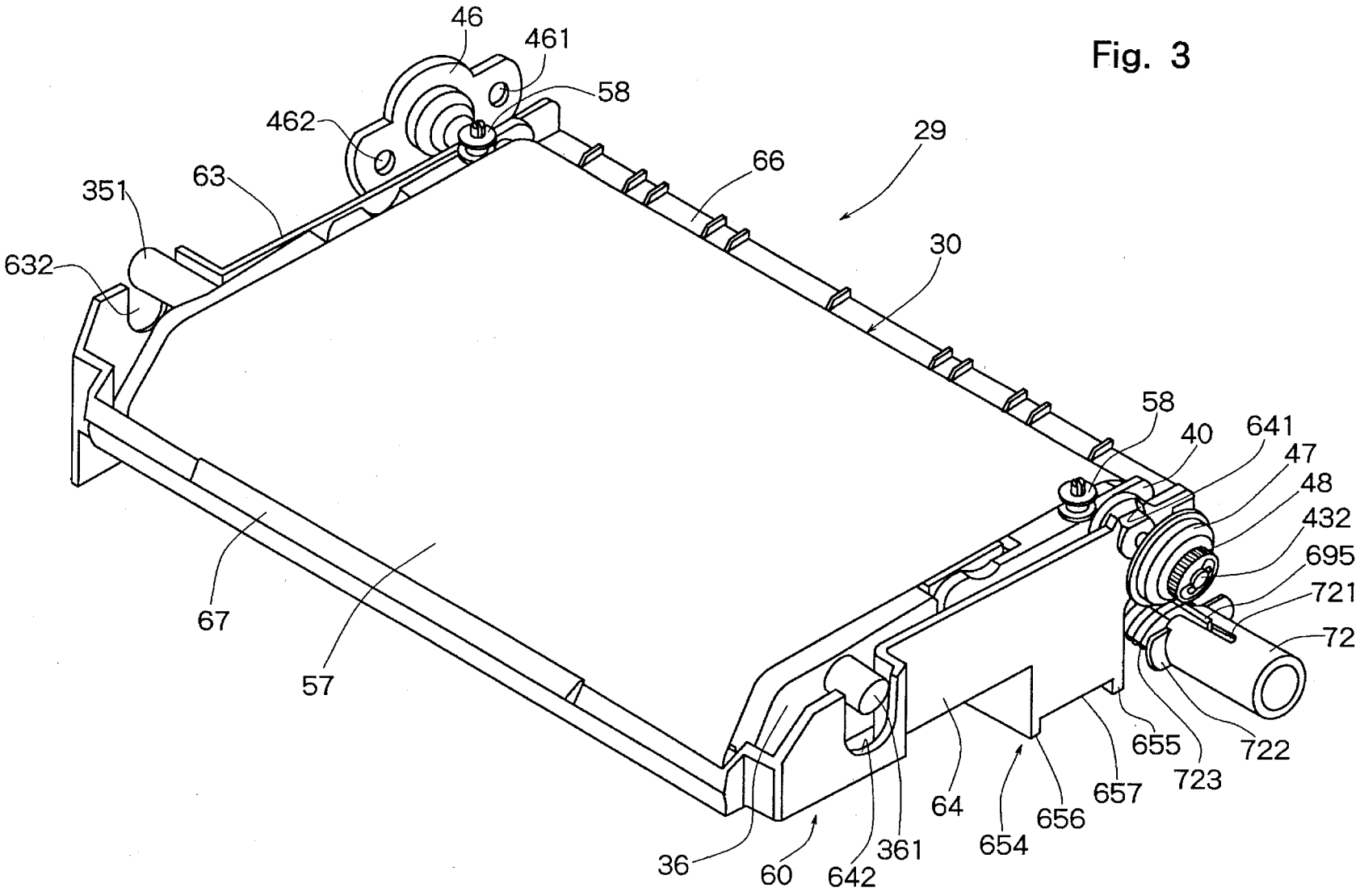
FIG. 3 is a perspective view of a transfer belt unit constituting a transfer device constructed in accordance with the present invention.
Figure 4:
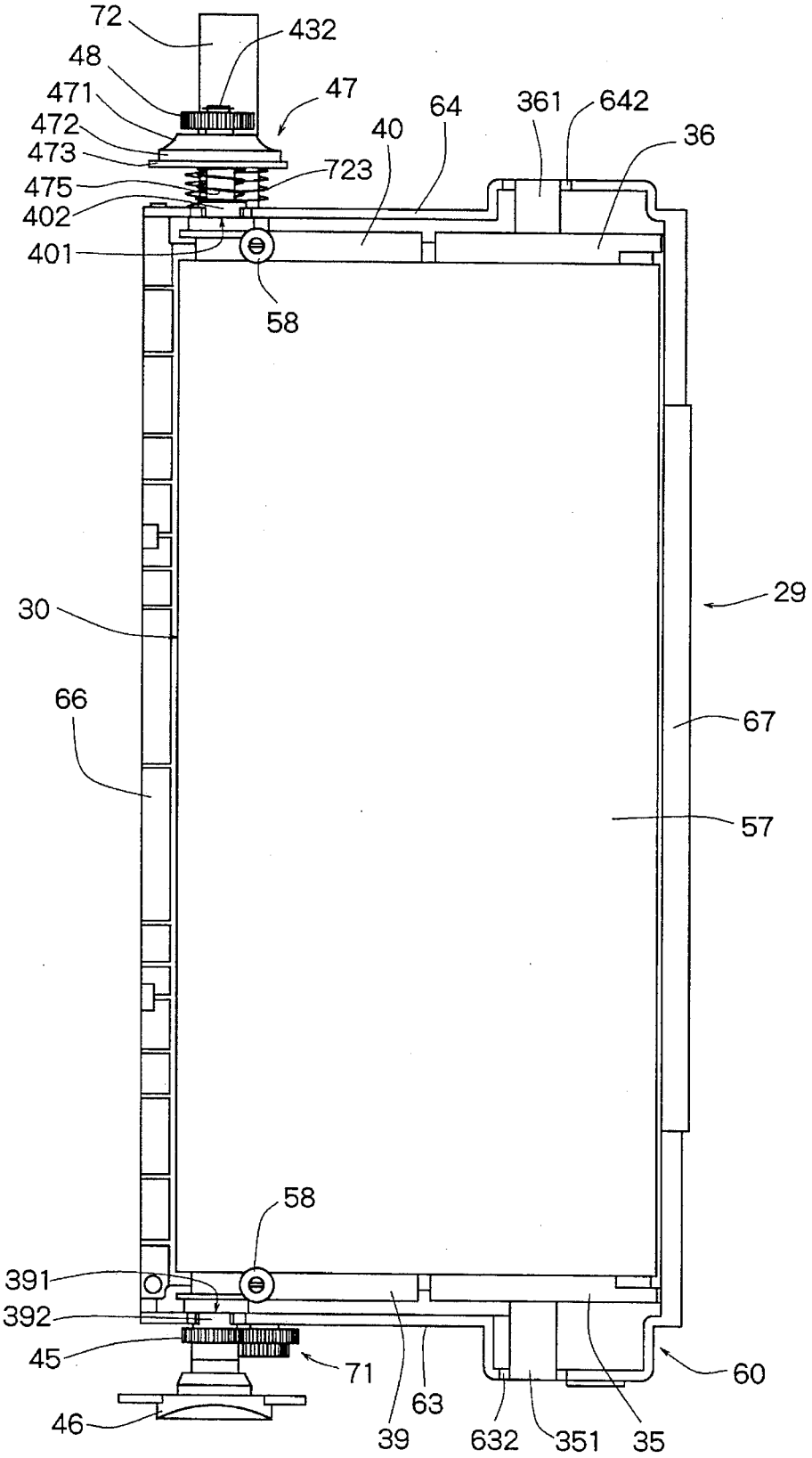
FIG. 4 is a plan view of the transfer belt unit shown in FIG. 3.
Figure 5:
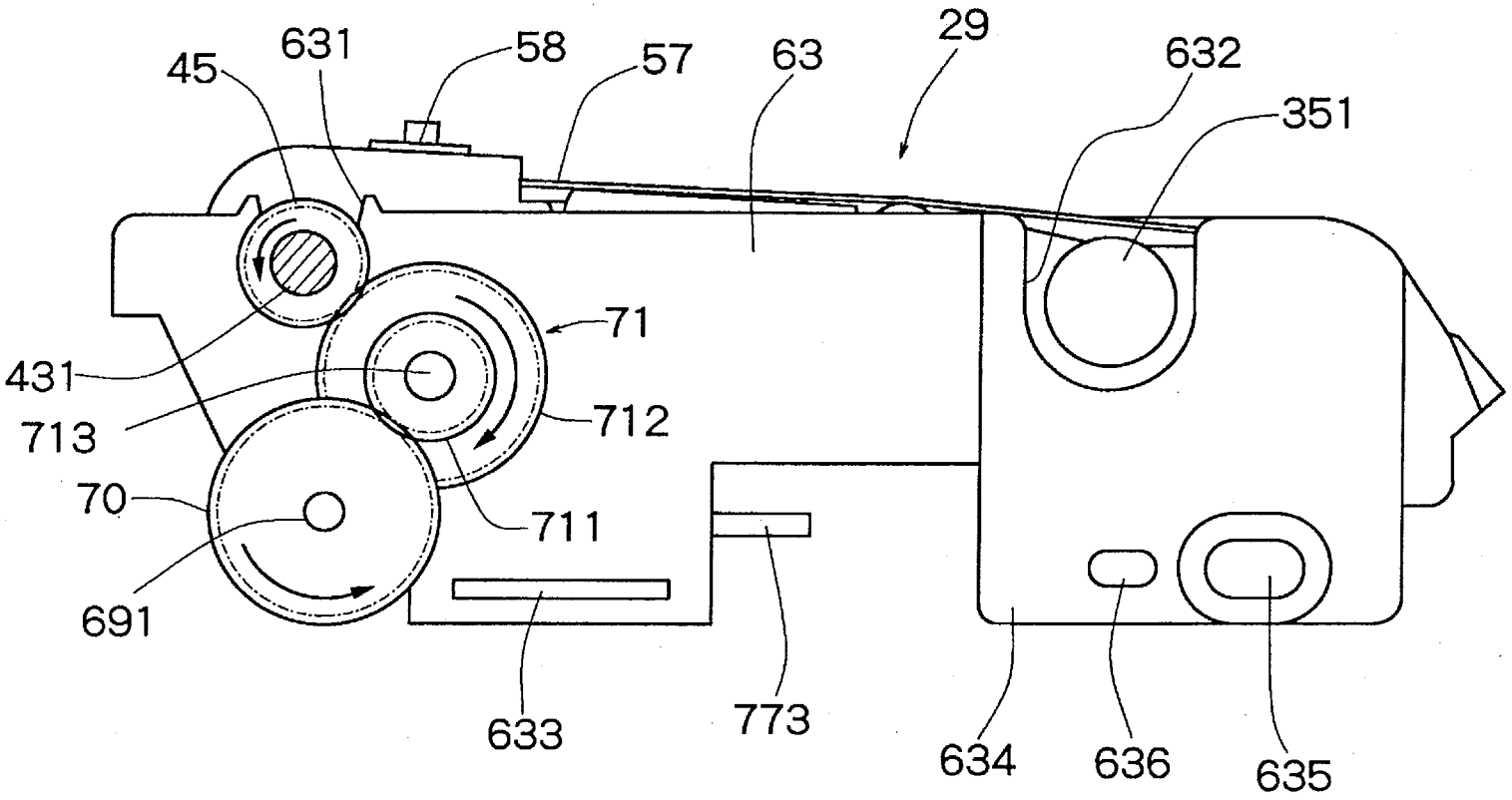
FIG. 5 is a front view, partly broken away, of the transfer belt unit shown in FIG. 3.
Figure 6:
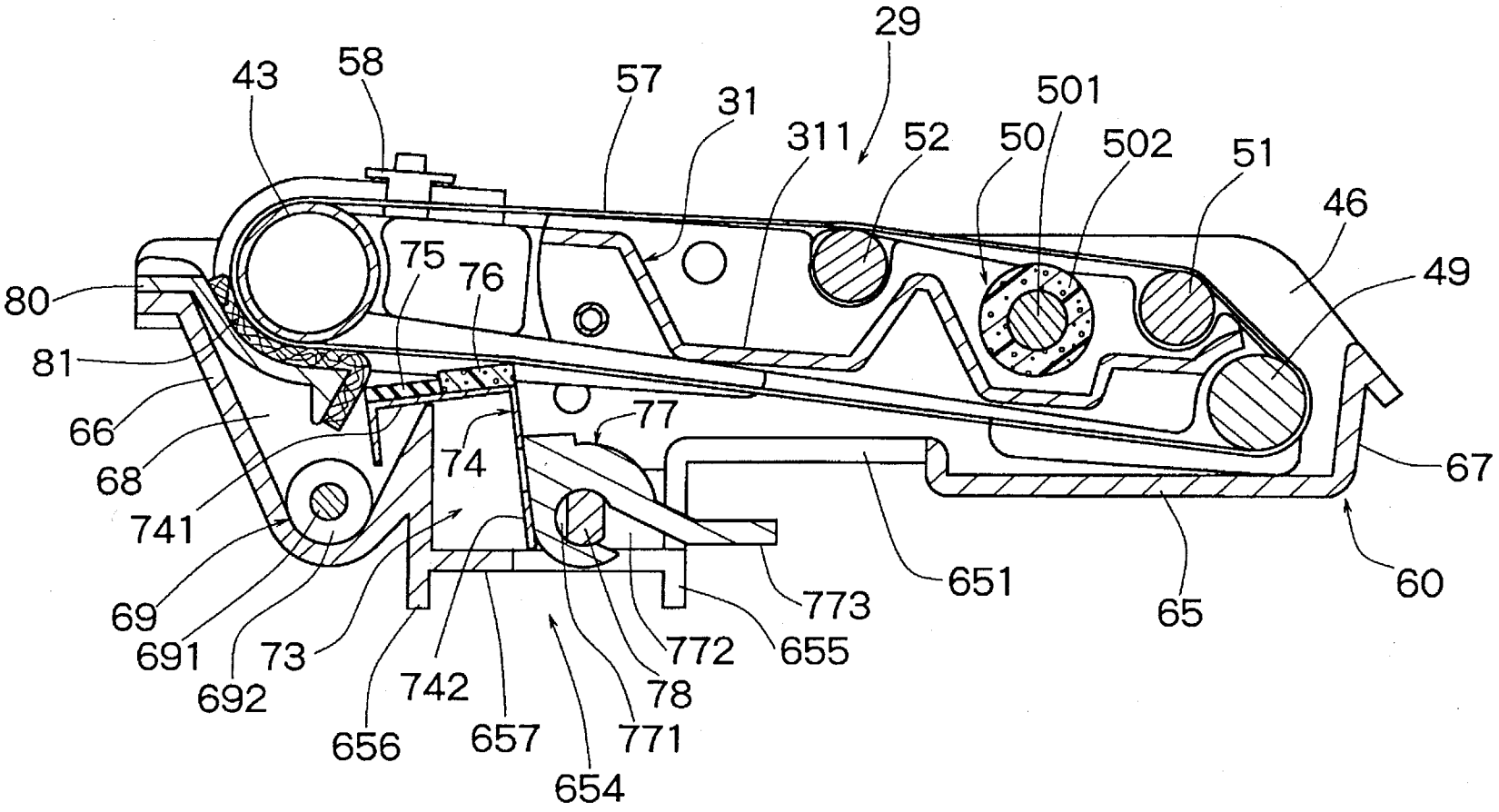
FIG. 6 is a sectional view of the transfer belt unit shown in FIG. 3.

Next, the transfer device 6 will be described with reference to FIGS. 3 to 20. FIG. 3 is a perspective view of a transfer belt unit constituting the transfer device. FIG. 4 is a plan view of the transfer belt unit. FIG. 5 is a front view, partly broken away, of the transfer belt unit. FIG. 6 is a sectional view of the transfer belt unit. The transfer belt unit 29 illustrated has a belt unit 30 and a unit housing 60 for housing and holding the belt unit 30.

Figure 7:
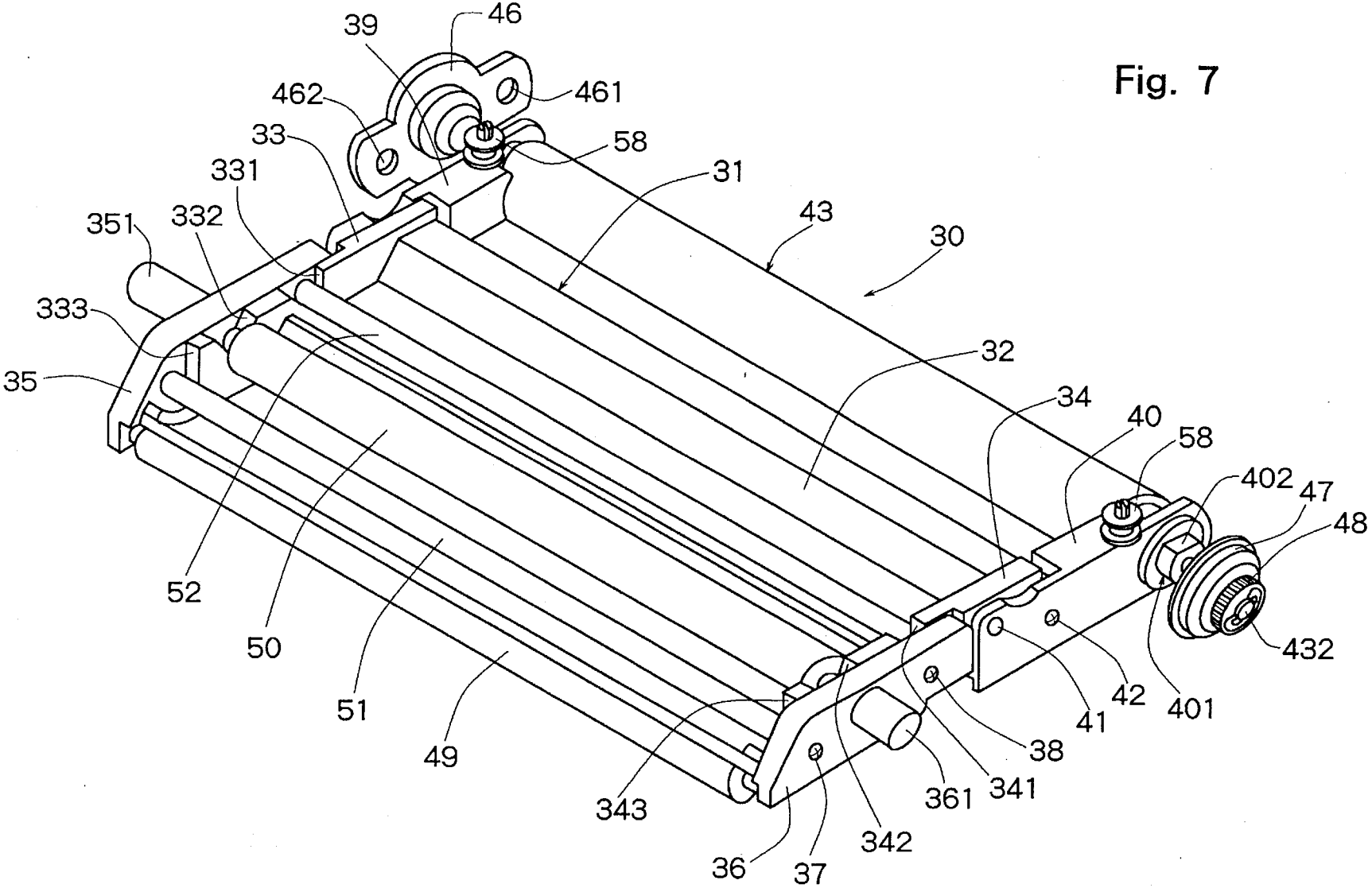
FIG. 7 is a perspective view of a belt unit of the transfer belt unit shown in FIG. 3.
Figure 8:
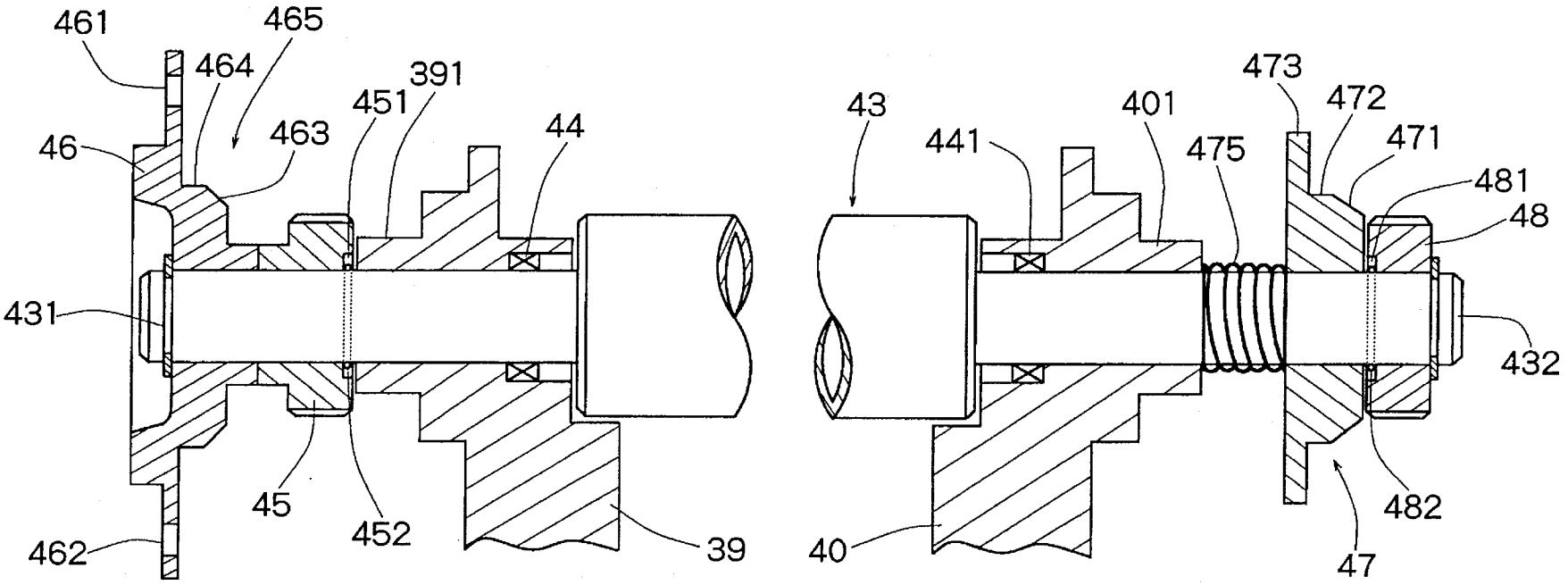
FIG. 8 is a sectional view of a driving roller of the belt unit shown in FIG. 7.
Figure 9:
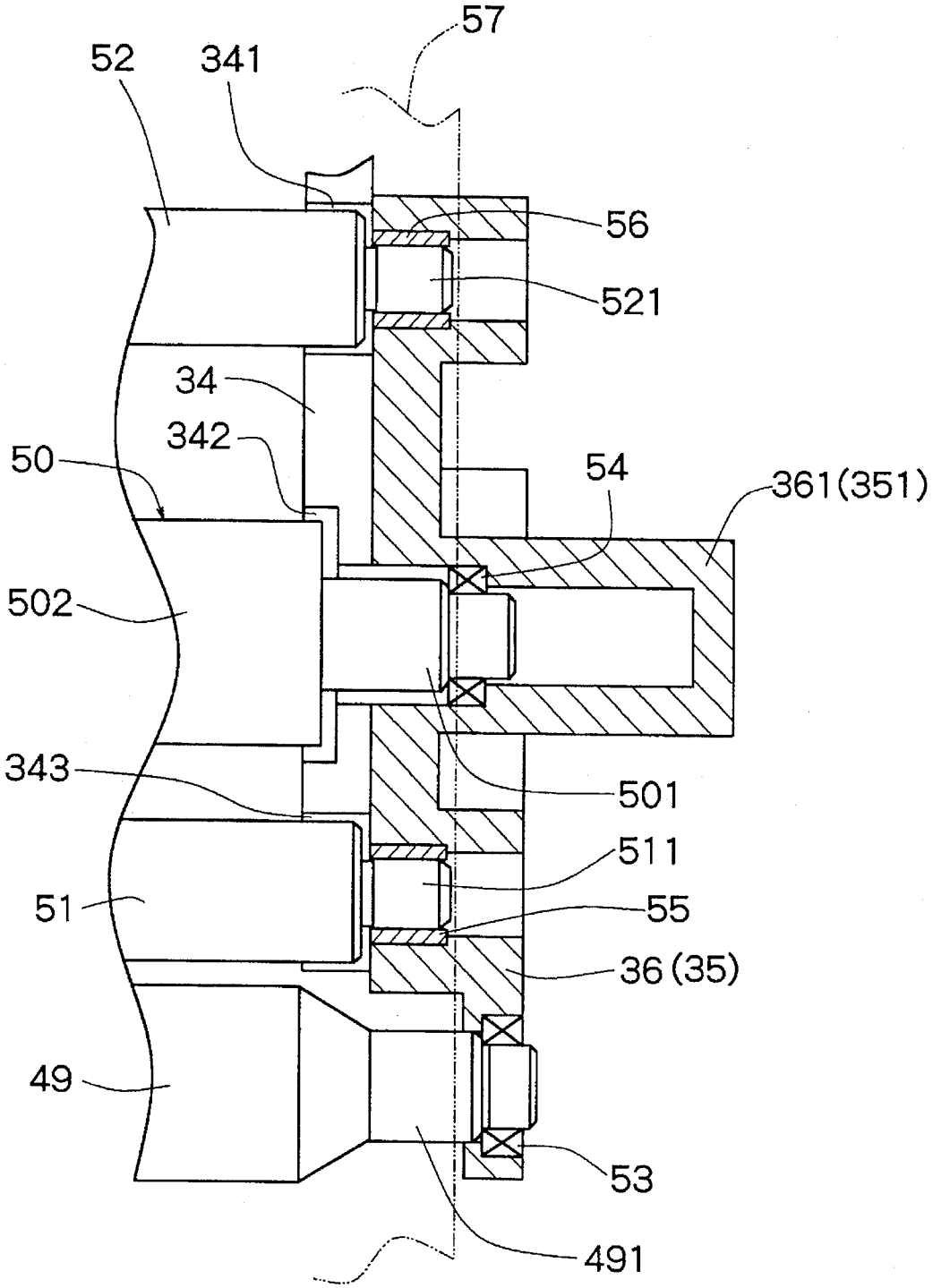
FIG. 9 is a sectional view showing a supporting structure for the respective rollers of the belt unit illustrated in FIG. 7.

The belt unit 30 will be described mainly with reference to FIGS. 7, 8 and 9. The illustrated belt unit 30 has a supporting frame 31 as clearly shown in FIG. 7. The supporting frame 31 has a base portion 32, and end walls 33 and 34 formed, respectively, at the front end and rear end of the base portion 32, and these are molded integrally from a plastic material. In the end walls 33 and 34 are formed, respectively, notched portions 331, 332, 333 and 341, 342, 343 which are all open upwards. To the end walls 33 and 34 are attached, by means of screws 37, 38 (FIG. 7 shows only those on the end wall 34 side), supporting plates 35 and 36 formed of a plastic material and supporting the respective rollers to be described later. At the central portions of the supporting plates 35 and 36, cylindrical stoppers 351 and 361 projecting forward (upper-leftward in FIG. 7) and rearward (lower-rightward in FIG. 7) are integrally formed. These stoppers 351 and 361 function to contact the underside of a holder which rotatably holds the image bearing member 3 and to regulate the positional relationship between the belt unit 30 and the image bearing member 3. Also on the end walls 33 and 34 of the supporting frame 31 are mounted plastic supporting plates 39 and 40 for supporting a driving roller to be described later. The supporting plates 39 and 40 are joined to side end portions of the supporting plates 35 and 36 by pins 41 (FIG. 7 shows only that on the supporting plate 40 side) so as to be free to pivot, and by screws 42 (FIG. 7 shows only that on the supporting plate 36 side) so as to be set in place. On the outside surfaces of the supporting plates 39 and 40 are provided, respectively, disk-shaped mounting portions 391 and 401. The mounting portions 391 and 401 are provided, respectively, with two parallel surfaces 392, 392 and 402, 402 on their outer peripheries (see FIG. 4).

Between the supporting plates 39 and 40 is disposed a driving roller 43. The driving roller 43 is formed of a hollow material of an aluminum alloy as illustrated in FIG. 8. To its front end (left end in FIG. 8) and rear end (right end in FIG. 8) are attached rotating shafts 431 and 432. The front rotating shaft 431 is journaled rotatably on a bearing 44 disposed in the supporting plate 39. On the front rotating shaft 431 is mounted a gear 45, which is adapted to turn integrally with the rotating shaft 431 because an engagement groove 451 formed on the side surface of the gear 45 engages a pin 452 disposed so as to pass diametrically through the rotating shaft 431. To a front end portion of the rotating shaft 431 is rotatably mounted a detachable member 46 having holes 461 and 462 for passage of mounting bolts. The detachable member 46 is provided with a position restricting means 465 which comprises a guide portion 463 having a conical surface, and a fitting portion 464 formed in continuation with the outer periphery of the guide portion 463. The functions of the thus constituted detachable member 46 will be described later. The rear rotating shaft 432 is journaled rotatably on a bearing 441 disposed in the supporting plate 40. To the rear rotating shaft 432 is rotatably mounted a position restricting member 47, which is pressed rightward in FIG. 8 by a coiled spring 475 disposed between the position restricting member 47 and the mounting portion 401. The position restricting member 47 comprises a guide portion 471 having a conical surface, a fitting portion 472 formed in continuation with the outer periphery of the guide portion 471, and a flange portion 473. The functions of the thus constituted position restricting member 47 will be described later. On the rear rotating shaft 432 is mounted a driven gear 48, which is adapted to turn integrally with the rotating shaft 432 because an engagement groove 481 formed on the side surface of the gear 48 engages a pin 482 disposed so as to pass diametrically through the rotating shaft 432.

Between the supporting plates 35 and 36 are disposed a driven roller 49, a transfer roller 50, a tension roller 51, and an earth roller 52. The supporting structure on the supporting plate 35 side for these respective rollers and that on the supporting plate 36 side for them are identical, and so only the supporting structure on the supporting plate 36 side is shown in FIG. 9.

The driven roller 49 is formed from a cylindrical material made of an aluminum alloy, and its opposite end portions each become a rotating shaft 491 with a reduced diameter. The rotating shaft 491 is rotatably journaled on a bearing 53 mounted on the supporting plate 36 (35).

Figure 21:
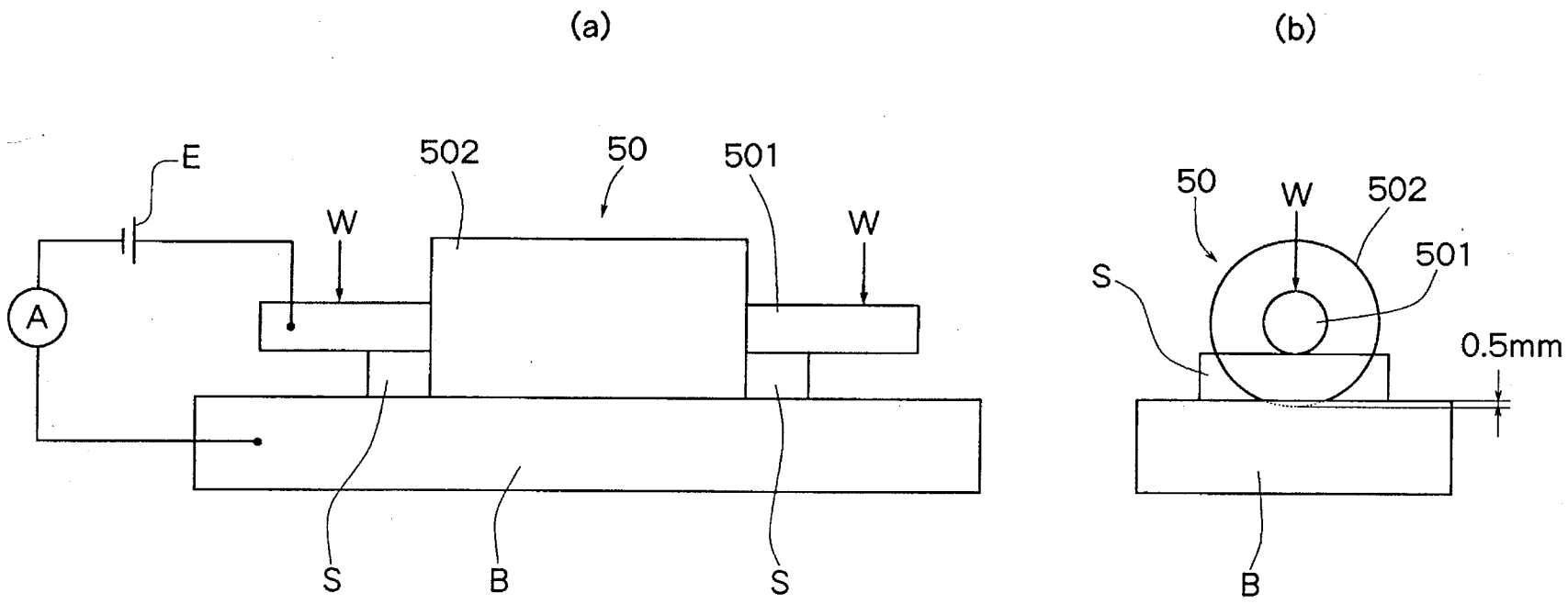
FIG. 21 shows the outline of a measuring device for measuring the volume resistivity of the transfer roller, with FIG. 21(*a*) being a front view and FIG. 21(*b*) is a side view.

The transfer roller 50 comprises a rotating shaft 501 formed from a cylindrical material made from a steel product, and a spongy roller portion 502 mounted on the outer peripheral surface of the rotating shaft 501 using a conductive adhesive (see FIG. 6). The spongy roller portion 502 is made by impregnating a roll member, formed of a foam such as urethane foam or silicone foam, with a conductive substance such as carbon. The volume resistivity of the roller portion 502 is set at $10^2$ to $10^9$ ohm-centimeters. The impregnation of the roll member constituting the roller portion 502 with the conductive substance can be performed, for example, by dipping the roll member, formed of a foam such as urethane foam or silicone foam, in a solution of a powder of a conductive substance such as carbon to impregnate the roll member with the solution, and then drying it. The volume resistivity of the roller portion 502 of the transfer roller 50 is measured by the method shown in FIG. 21. That is, the transfer roller 50 is placed on a base B formed of a conductive material, and spacers S, having such a height that when the roller portion 502 is compressed by 0.5 mm, the rotating shaft 501 contacts the spacers S, are disposed at sites facing the rotating shaft 501. With the rotating shaft 501 being contacted with the spacers S under a load W imposed on both end portions of the rotating shaft 501, a predetermined voltage (10 V in the instant embodiment) is applied between the rotating shaft 501 and the base B by a direct current power source E. A current flowing between the rotating shaft 501 and the base B is measured by an ammeter A. Based on that voltage and the current measured, electrical resistance between the rotating shaft 501 and the base B is determined. The hardness of the roller portion 502 is set at a compression of 0.45 to 2.00 mm at a linear pressure of 3 g/cm. The reason the roller portion 502 of the transfer roller 50 is composed of a relatively soft material such as a foam, e.g., urethane foam or silicone foam, having hardness expressed by a compression of 0.45 to 2.00 mm at a linear pressure of 3 g/cm is as follows: Our tests showed that when the roller portion of the transfer roller was composed of a relatively hard material such as hard rubber, the pressure at the transfer point was high, and no problem occurred with an ordinary transfer paper. However, for an OHP film or the like, to which a toner adheres with difficultly, a partial missing phenomenon tends to occur in which the middle of the line of the image remains on the image bearing member without being transferred to the film. In the light of this finding, we tested various transfer rollers made of urethane foams. The tests showed that when the hardness of the roller portion was represented by a compression of less than 0.45 mm at a linear pressure of 3 g/cm, the partial missing phenomenon occurred during transfer to an OHP film; whereas when the hardness of the roller portion was lower, no partial missing phenomenon occurred. However, when the hardness of the roller portion was low enough to involve a compression of greater than 2.00 mm at a linear pressure of 3 g/cm, a predetermined frictional force was not obtained, making free-running with the transfer belt difficult. Also, a shearing force between the transfer belt and the roller portion damaged the surface of the roller portion. It was thus found that the hardness of the roller portion of the transfer roller should desirably be represented by a compression of 0.45 to 2.00 mm at a linear pressure of 3 g/cm. The opposite end portions of the rotating shaft 501 constituting the transfer roller 50 are each journaled rotatably by a bearing 54 mounted on the supporting plate 36 (35). The bearing 54 is disposed at a position facing the cylindrical stopper 361 (351) where it is embedded in the stopper 361 (351) side from the internal surface of the supporting plate 36 (35). Therefore, toner powder or dust minimally penetrates the bearing 54 from inside the supporting plate 36 (35). The rotating shaft 501 of the transfer roller 50 is adapted to be given a predetermined voltage by the voltage applying means 200 shown in FIG. 1.

The tension roller 51 is disposed between the driven roller 49 and the transfer roller 50, and is formed from a cylindrical material made of an aluminum alloy. Its opposite end portions each become a rotating shaft 511 with a reduced diameter. The rotating shaft 511 is rotatably journaled on a bearing 55 mounted on the supporting plate 36 (35).

The earth roller 52 is disposed between the transfer roller 50 and the driven roller 43 and is formed from a cylindrical material made of an aluminum alloy. Its opposite end portions each become a rotating shaft 521 with a reduced diameter. The rotating shaft 521 is rotatably journaled on a bearing 56 mounted on the supporting plate 36 (35). The earth roller 52 is grounded by a suitable earth means. The earth roller 52, the tension roller 51 and the transfer roller 50 are in the following positional relationship: The transfer roller 50 is disposed such that the upper surface of its outer peripheral surface is situated below a straight line connecting together the upper surfaces of the outer peripheral surfaces of the earth roller 52 and the tension roller 51 as viewed in FIG. 6. Thus, in a state in which a transfer belt 57, to be described later, is wound over these rollers, the transfer roller 50 separates from the transfer belt 57 (see FIG. 6).

In the manner noted above, an endless transfer belt 57 is wound over the driving roller 43, driven roller 49, transfer roller 50, tension roller 51 and earth roller 52 mounted on the supporting plates 39 and 40 and the supporting plates 35 and 36. The transfer belt 57 is formed of a semiconductive material such as polychloroprene, and its volume resistivity is set at $10^9$ to $10^{12}$ ohm-centimeters. In mounting the transfer belt 57 over the respective rollers, the screws 42 that fix the supporting plates 39 and 40 to the end walls 33 and 34 of the supporting frame 31 are loosened to release the fixing of the supporting plates 39 and 40 to the end walls 33 and 34 of the supporting frame 31, and the supporting plates 39 and 40 are pivoted about the pins 41. By so pivoting the supporting plates 39 and 40 about the pins 41, the transfer belt 57 can be easily fitted over the respective rollers. Then, the supporting plates 39 and 40 are pivoted back about the pins 41 to their original positions, and the screws 42 are tightened, whereby the transfer belt 57 can be mounted with a predetermined tension. The width of the transfer belt 57 is set to be larger than the distance between the supporting plates 35 and 39 and the supporting plates 36 and 40 so that the edges of the transfer belt 57 are situated at the central portions of the supporting plates 35 and 39 and the supporting plates 36 and 40. Hence, toner powder adhered to the transfer belt 57 minimally penetrates the space defined by the supporting plates 35, 39, the supporting plates 36, 40, and the transfer belt 57. To prevent the transfer belt 57 from snaking during its operation, anti-snaking members 58, 58 are attached to the upper surfaces of the supporting plates 39 and 40.

Next, a unit housing 60 for accommodating and holding the belt unit 30 will be described with reference to FIG. 10.

Figure 10:
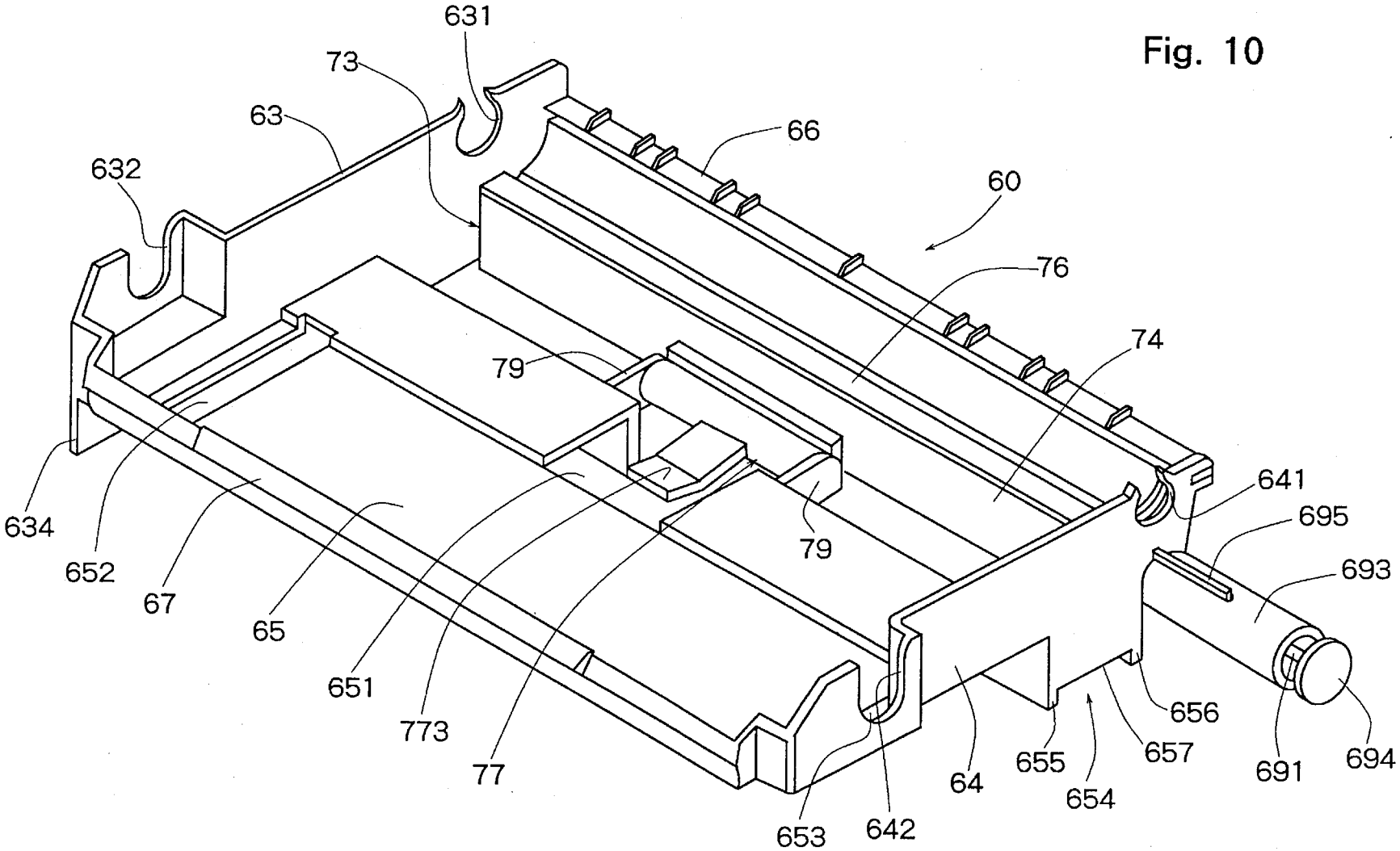
FIG. 10 is a perspective view of a unit housing of the transfer belt unit shown in FIG. 3.
Figure 11:
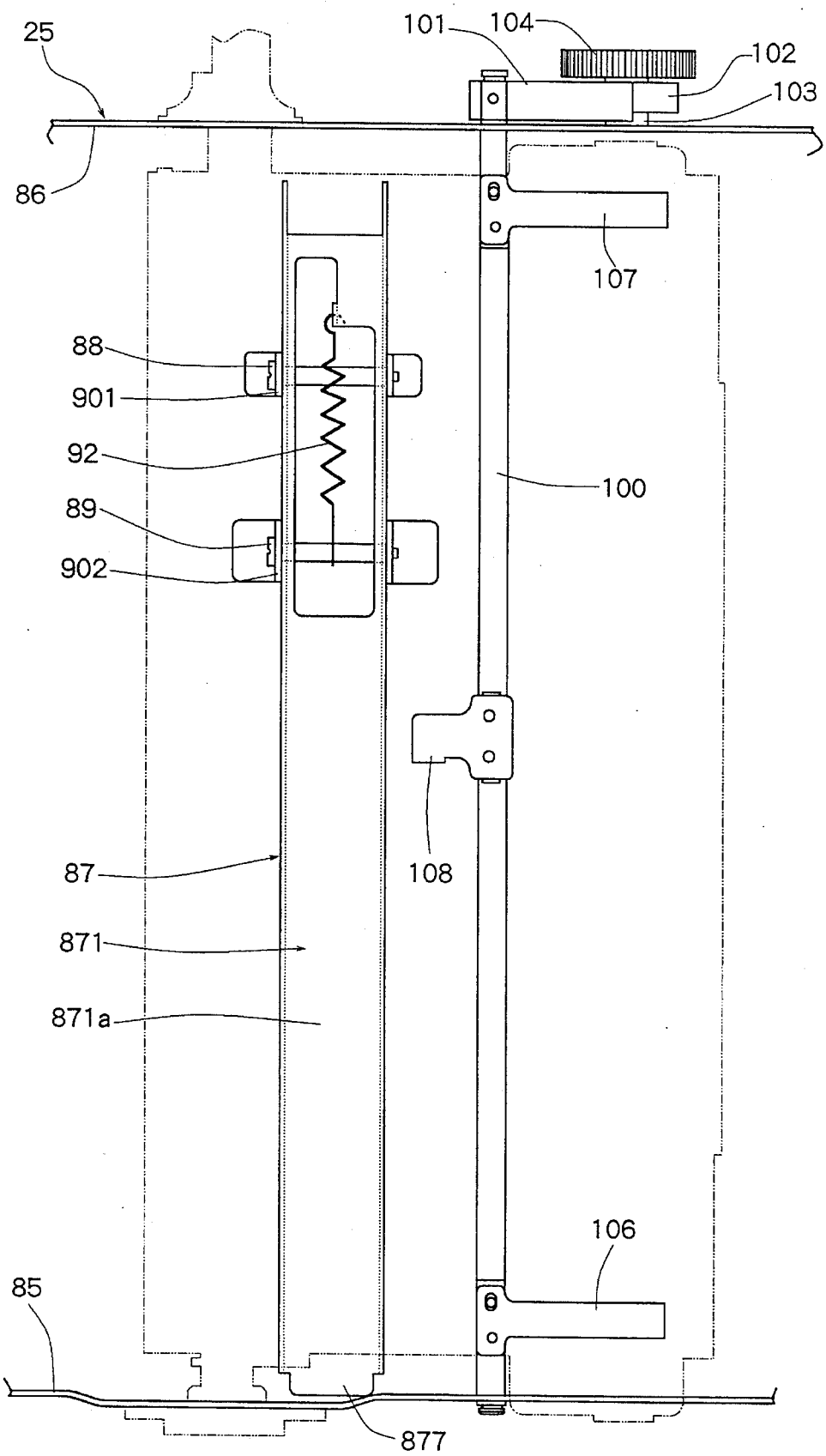
FIG. 11 is a plan view showing a mounting portion of a machine body housing on which the transfer belt unit illustrated in FIG. 3 is to be mounted.

The unit housing 60 in the illustrated embodiment, as shown in FIG. 10, has a front side wall 63, a rear side wall 64, a bottom wall 65, a left side wall 66, and a right side wall 67, and is open upwards. These walls are integrally formed of a plastic material. In those upper parts of the front side wall 63 and the rear side wall 64 which rest on the left side wall 66 side in FIG. 10, there are formed circular supporting holes 631 and 641 which rotatably support the mounting portions 391 and 401 provided on the supporting plates 39 and 40 to journal the driving roller 43 of the belt unit 30. The circular supporting holes 631 and 641 correspond in diameter with the mounting portions 391 and 401, and are open upwards. The width of the opening corresponds with the width of each of the two parallel surfaces 392, 392 and 402, 402 formed in the mounting portions 391 and 401. Thus, the two parallel surfaces 392, 392 and 402, 402 of the mounting portions 391 and 401 are inserted into the circular supporting holes 631 and 641 from above in correspondence with the openings of the circular supporting holes 631 and 641, and the belt unit 30 is pivoted through approximately 90° about the mounting portions 391 and 401, whereby the belt unit 30 can be mounted on the unit housing 60. Those end portions of the front side wall 63 and the rear side wall 64 which rest on the right side wall 67 side are formed so as to project forward and rearward. In the upper parts of these end portions are formed notched portions 632 and 642 for permitting the movement of the stoppers 351 and 361 of the belt unit 30. At the projection of the front side wall 63 where the notched portion 632 is formed there is provided a mounting portion 634 protruding downwardly of the bottom wall 65. In the mounting portion 634 are formed an elliptic positioning hole 635 and an elliptic hole 636 for passage of a mounting bolt, as shown in FIG. 5. A slightly left-hand portion, relative to the center, of the front side wall 63 in FIG. 5 is formed so as to project downwardly, and its projection has an engagement hole 633 at a position aligning with a slide rail to be described later. In the bottom wall 65 is provided a slide rail 654 which is formed downwardly projectively at a position aligning with the engagement hole 633 formed in the front side wall 63 and which extends from the front end portion to the rear end portion of the bottom wall 65. The slide rail 654 has guides 655, 656 projecting downwardly on either side thereof, and a slide surface 657 formed between the guides 655 and 656. The slide surface 657 is formed at nearly the same level as the upper end of the engagement hole 633 formed in the front side wall 63. In the bottom wall 65 is formed an opening 651 at the center, and openings 652 and 653 are formed in those front and rear end portions of the bottom wall 65 which are beside the right side wall 67. The functions of the openings 651, 652 and 653 will be described later.

In that part of the unit housing 60 which is beside the left side wall 66 is formed a waste toner accommodating portion 68 extending in the back-and-forth direction along the left side wall 66, as shown in FIG. 6. In a lower part of the waste toner accommodating portion 68 is disposed a toner carriage member 69. The toner carriage member 69 has a rotating shaft 691 and a spiral blade 692 mounted on the rotating shaft 691. The toner carriage member 69 has an end portion of the rotating shaft 691 journaled rotatably on the front side wall 63. The other end portion of the rotating shaft 691 is open to the waste toner accommodating portion 69, and a part of the spiral blade 692 is supported rotatably by a guide cylinder 693 provided so as to project rearwardly from the rear side wall 64 (see FIG. 10). To an end of the rotating shaft 691 is mounted a driven gear 70 which engages a pinion 711 of an intermediate gear 71 journaled rotatably on a shaft 713 provided in the front side wall 63, as shown in FIG. 5. The intermediate gear 71 has a wheel 712 integrally with the pinion 711, and the wheel 712 is adapted to engage the gear 45 mounted on the rotating shaft 431 of the driving roller 43. The other end portion of the rotating shaft 691 projects beyond the front end of the guide cylinder 693, and has at its front end a blocking disk 694 having nearly the same outside diameter as the outside diameter of the guide cylinder 693. Over the guide cylinder 693 is fitted a blocking cylinder 72 as shown in FIG. 3. The blocking cylinder 72 has an engagement groove 721 formed axially from the internal end thereof. Since the engagement groove 721 engages a ridge 695 provided on the guide cylinder 693, the blocking cylinder 72 can move axially, but its rotation is restricted. Also, the blocking cylinder 72 has a flange 722 at its internal end and is pushed rearward by a coiled spring 723 disposed between the flange 722 and the rear side wall 64.

The unit housing 60 has along the waste toner accommodating portion 68 a cleaning means 73 for cleaning the transfer belt 57 of the belt unit 30. As seen in FIG. 6, the cleaning means 73 in the illustrated embodiment has a common holder 74, a cleaning blade 75, and a paper dust removing member 76. The common holder 74 comprises a channel-like member having nearly the same length as the width of the transfer belt 57, and has a mounting portion 741 and a supporting portion 742. To a central part of the supporting portion 742 of the holder 74 is secured a mounting member 77. The mounting member 77 has at its base portion a hole 771 of a circular cross section drilled through the mounting member 77 in the longitudinal direction and partly having an opening portion 772. At a central portion of the mounting member 77 is integrally formed an operated lever 773. A supporting shaft 78 (see FIG. 6) for turnably supporting the mounting member 77 is provided at the bottom wall 65 of the unit housing 60. The supporting shaft 78 is formed integrally with supporting walls 79, 79 which project from the bottom wall 65, and has two parallel surfaces with dimensions consistent with the diameter of the hole 771 and consistent with the opening width of the opening portion 772 at the outer periphery. To mount the mounting member 77 on the supporting shaft 78, the opening portion 772 is aligned with the two parallel surfaces formed in the supporting shaft 78, and the hole 771 is fitted over the supporting shaft 78 from above. Then, the mounting member 77 is turned through about 90°, whereby the operated lever 773 is positioned so as to project from the opening 651 formed in the bottom wall 65, as shown in FIGS. 6 and 10. The cleaning blade 75 is formed of urethane rubber or the like, has nearly the same length as the width of the transfer belt 57, and is secured to the mounting portion 741 of the holder 74 by use of an adhesive or the like. The cleaning blade 75 has its edge in contact with the transfer belt during transfer (see FIG. 20), thereby scraping off the toner adhered to the transfer belt 57. The paper dust removing member 76 is composed of a foamed material, such as a sponge, has nearly the same length as the width of the transfer belt 57, and is secured to the mounting portion 741 of the holder 74 by use of an adhesive or the like. The cleaning blade 75 also has nearly the same length as the width of the transfer belt 57. The paper dust removing member 76 is disposed downstream of the cleaning blade 75 in the direction of operation of the transfer belt 57 and is formed so as to be thicker than the cleaning blade 75. The paper dust removing member 76 is adapted to partially contact the transfer belt 57 during a non-transfer period as well as during a transfer procedure. The paper dust removing member 76 removes paper dust adhered to the transfer belt 57 which is difficult for the cleaning blade 75 to remove and has the function of smoothing the toner accumulated at the position of contact when the cleaning blade 75 leaves the transfer belt 57. At the upper end of the left side wall 66 of the unit housing 60 is mounted a sealing plate 80 which covers the top of the waste toner accommodating portion 68. The sealing plate 80 extends from the front side wall 63 to the rear side wall 64 and has a sealing material 81, such as pile wool, sponge or felt, on its surface facing the transfer belt 57 and at its portion facing the cleaning blade 75. As shown in FIG. 6, the edge portion of the cleaning blade 75 is brought into contact with the sealing material 81 during a non-transfer period. Hence, the toner or paper dust adhered to the edge portion of the cleaning blade 75 can be removed during each non-transfer.

Figure 12:
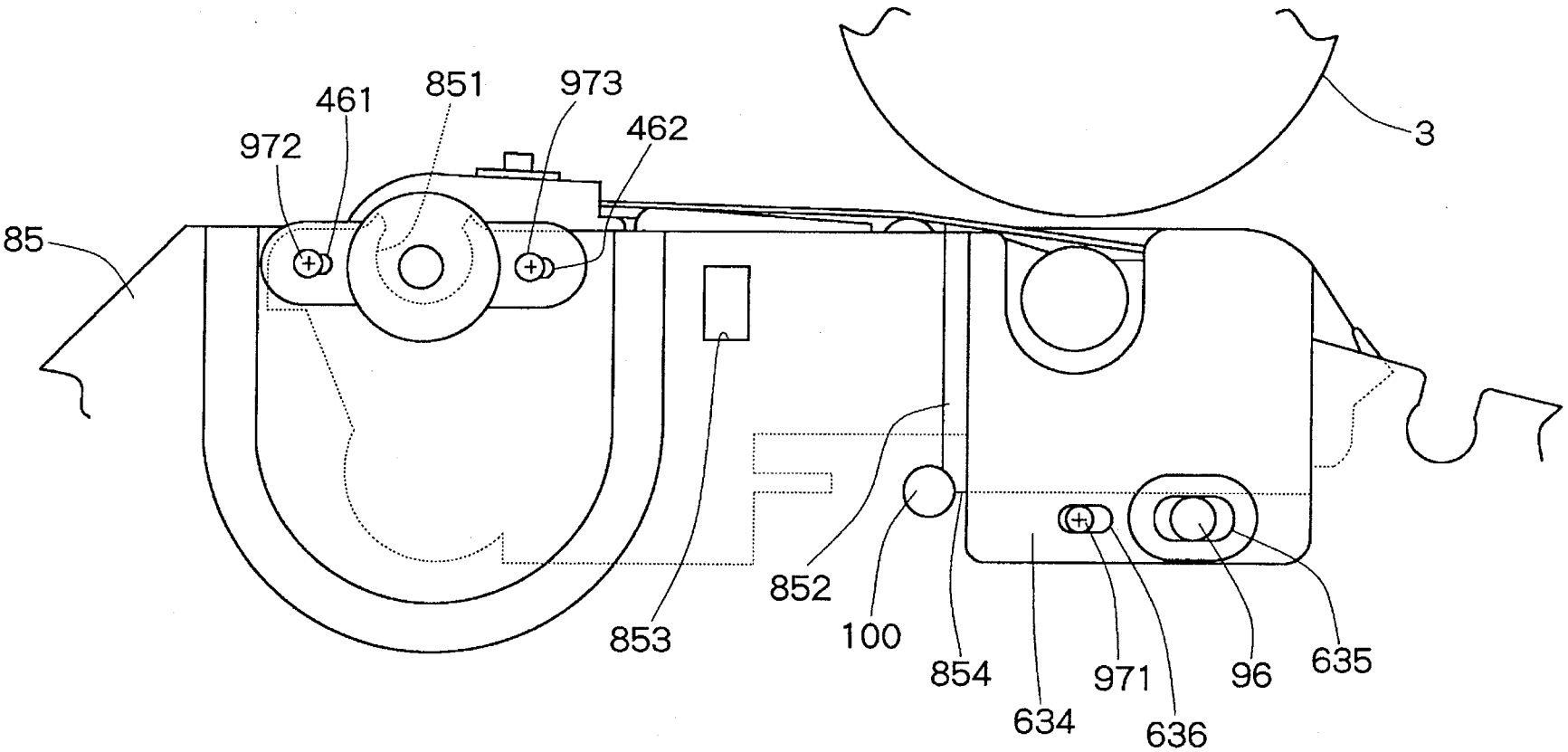
FIG. 12 is a front view showing a state in which the transfer belt unit illustrated in FIG. 3 is mounted on the machine body housing.
Figure 13:
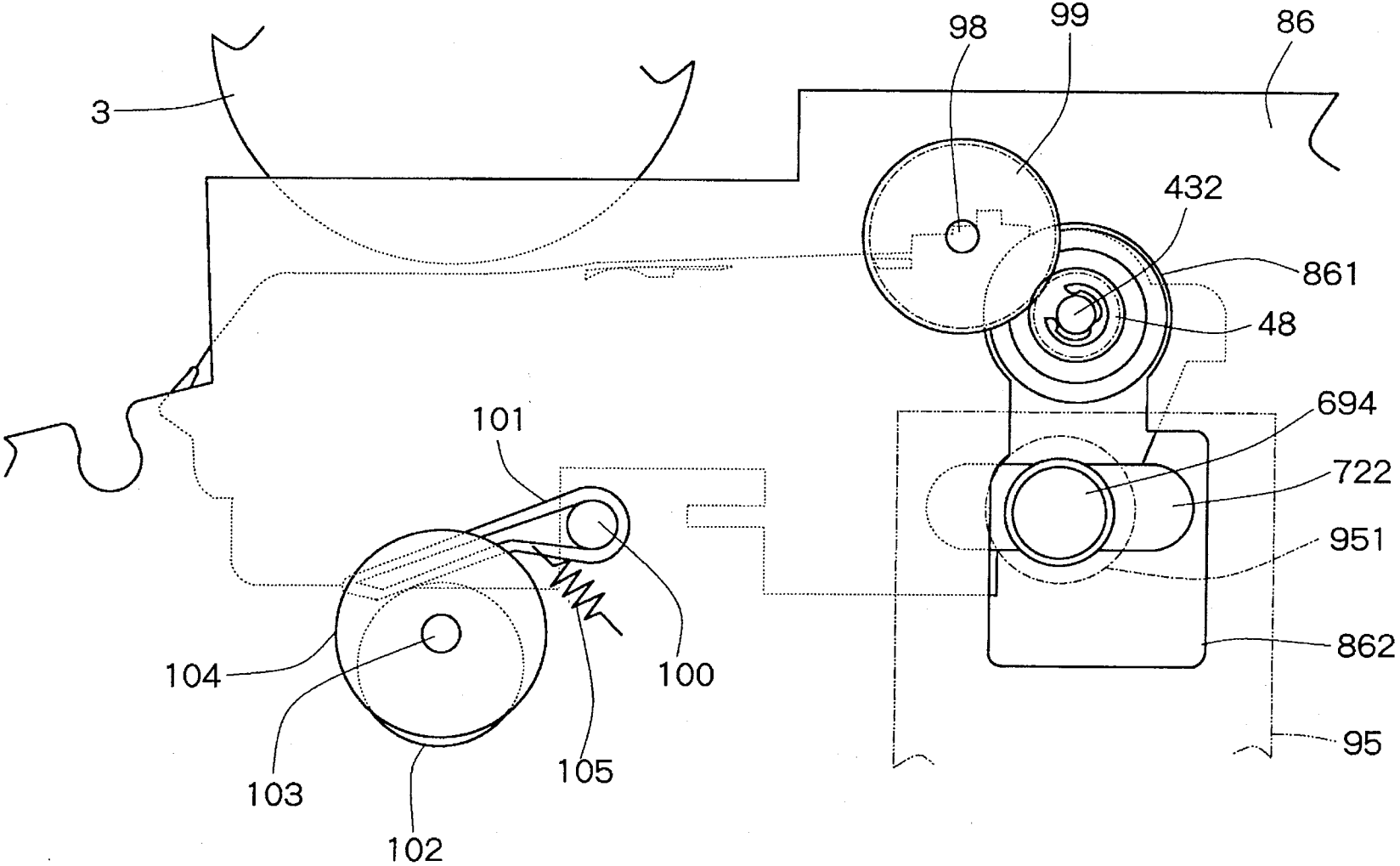
FIG. 13 is a rear view showing a state in which the transfer belt unit illustrated in FIG. 3 is mounted on the machine body housing.

Next, the slider mechanism for mounting the thus constituted transfer belt unit 29 on the lower housing 25 of the clamshell type will be described with reference to FIGS. 11 to 20. The lower housing 25 has a front side plate 85, a rear side plate 86 disposed at a distance from the front side plate 85, and a base plate 90 disposed between the front side plate 85 and the rear side plate 86. The front side plate 85, as shown in FIG. 12, is provided with a circular supporting hole 851 formed so as to be open upwards in correspondence with the fitting portion 464 of the detachable member 46 in the transfer belt unit 29, is provided with a rectangular notched portion 852 in correspondence with the mounting portion 634 formed in the front side wall 63 of the unit housing 60, and is provided with a hole 853 engaging the engaging portion of a slider to be described later. In the rear side plate 86, as shown in FIG. 13, are provided a hole 861 conforming to the fitting portion 472 of the position restricting member 47 in the transfer belt unit 29, and a hole 862 through where the blocking cylinder 72 can pass.

Figure 14:
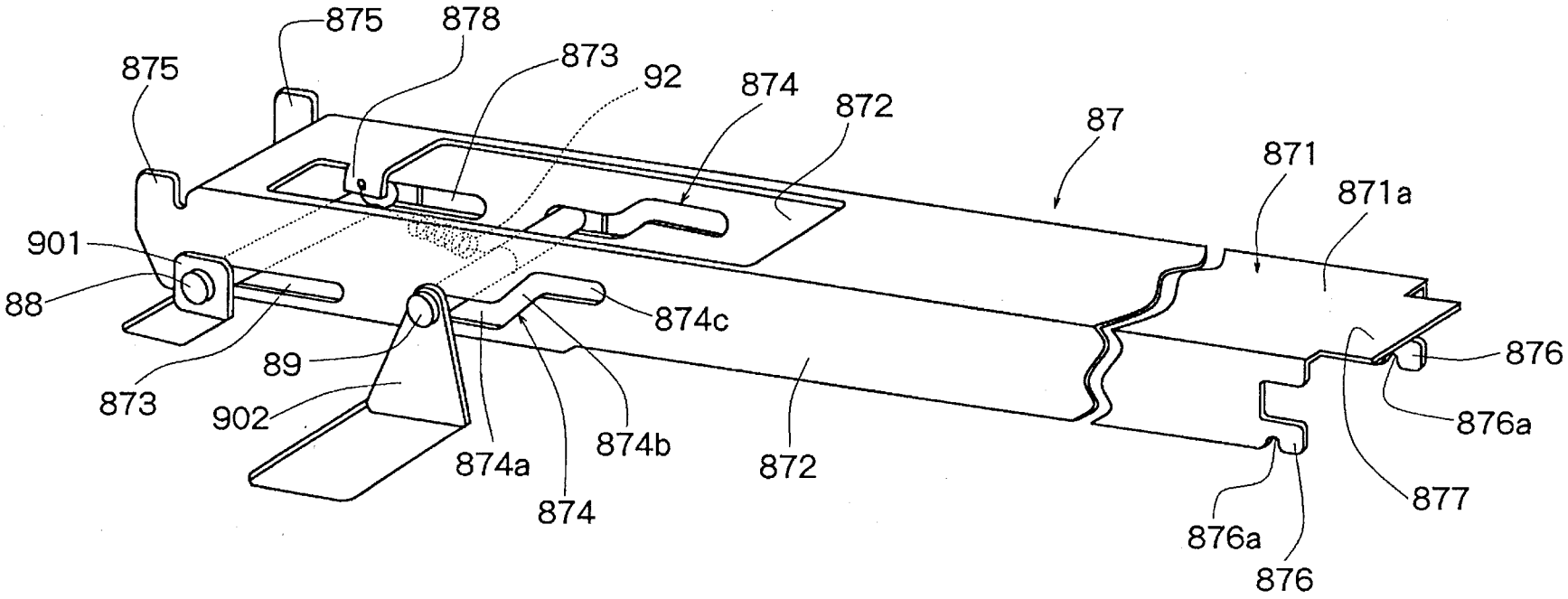
FIG. 14 is a perspective view of a slider for mounting the transfer belt unit of FIG. 3 on the machine body housing.
Figure 15:
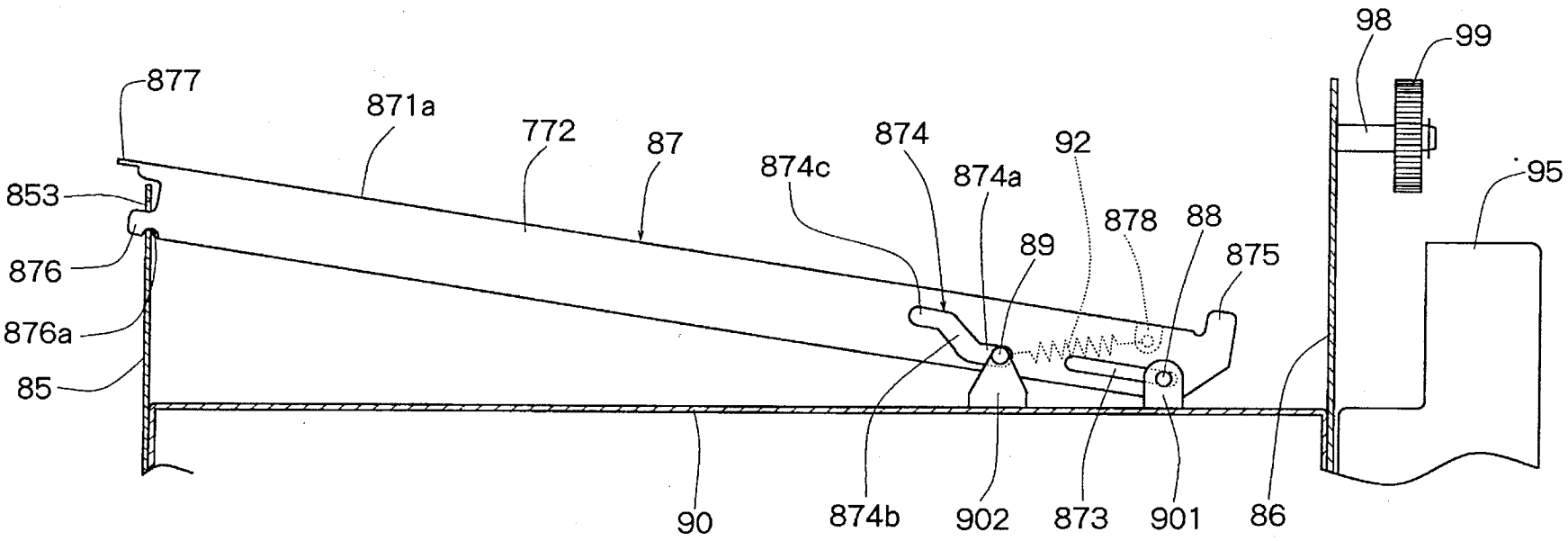
FIG. 15 is a side view showing a state in which the slider of FIG. 14 has been pulled out.
Figure 16:
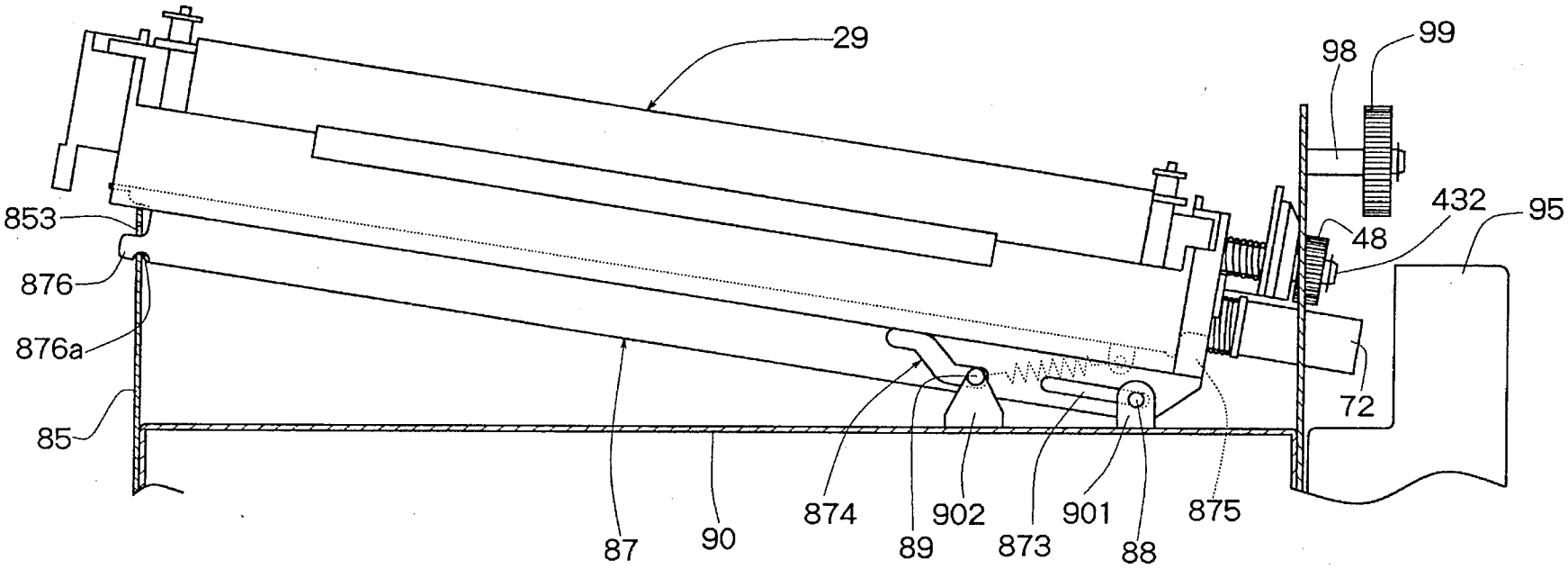
FIG. 16 is a side view showing a state in which the transfer belt unit is placed on the slider of FIG. 15.

On the base plate 90 of the lower housing 25 is disposed a slider 87 extending between the front side plate 85 and the rear side plate 86. The slider 87 is composed with a steel material of a channel-like cross section as depicted in FIG. 14, the and its width is consistent with the width of the slide surface 657 formed between the guides 655 and 656 of the slide rail 654. The upper surface of its top plate 871 forms a bearing surface 871a for bearing the slide surface 657 of the slide rail 654. In the opposite side plates 872, 872 of the slider 87 are provided first elongate holes 873, 873 and second elongate holes 874, 874 each extending in the back-and-forth direction toward the rear portion (upwards in FIG. 11, and rightwards in FIGS. 15 to 18). The first elongate holes 873, 873 provided on the rear end side are formed in a straight line parallel to the bearing surface 871*a*. The second elongate holes 874, 874 provided on the front side relative to the first elongate holes 873, 873 are formed of a first parallel portion 874*a* parallel to the bearing surface 871*a*, an inclined portion 874*b* inclined upwards from the front end of the first parallel portion 874*a*, and a second parallel portion 874*c* extending parallel to the bearing surface 871*a* toward the front side from the upper end of the inclined portion 874*b*. At the rear ends of the opposite side plates 872, 872 are provided stoppers 875, 875 projecting upwardly of the bearing surface 871*a*. At the front ends of the opposite side plates 872, 872 are provided engagement portions 876 which fit into the hole 853 formed in the front side plate 85 (see FIGS. 12 and 15), and which have engagement depressions 876*a* for holding the slider 87 in an inclined state. At the front end of the top plate 871 is provided an engagement portion 877 which engages the engagement hole 633 formed in the front side wall 63 of the unit housing 60. The engagement portion 877 and the engagement hole 633 formed in the front side wall 63 constitute an engaging means in which they engage each other. The so constituted slider 87 has a first supporting pin 88 inserted into the first elongate holes 873, 873 formed in the opposite side plates 872, 872, and a second supporting pin 89 inserted into the second elongate holes 874, 874. Both ends of the first and second supporting pins 88 and 89 are supported, respectively, by supporting brackets 901, 901 and 902, 902 formed by cutting and erecting a part of the base plate 90. The first elongate holes 873, 873 and the second elongate holes 874, 874 formed in the opposite side plates 872, 872 of the slider 87, and the first supporting pin 88 and the second supporting pin 89 supported, respectively, by the supporting brackets 901, 901 and 902, 902 constitute a supporting means which supports the slider 87 so as to be movable in the back-and-forth direction and to be free to pivot in the up-and-down direction about the rear end portion. A coiled tension spring 92 is placed between the second supporting pin 89 and an engagement portion 878 provided in the top plate 871 of the slider 87 on the rear side relative to the second supporting pin 89. By the tension of the coiled tension spring 92, the slider 87 is constantly urged toward the front side. Thus, the slider 87, as assembled, has its front end contacting the front side plate 85 (see FIG. 11). In this condition, the first supporting pin 88 is situated nearly at the center of the first elongate holes 873, 873 formed in the opposite side plates 872, 872 of the slider 87, and the second supporting pin 89 is situated at the junction between the inclined portion 874*b* and the second parallel portion 874*c* of the second elongate holes 874, 874. When the front end portion of the slider 87 is lifted upward from this state, the slider 87 turns about the first supporting pin 88, Simultaneously, the slider 87 is guided by the second elongate holes 874, 874 and the second supporting pin 89, whereby the slider 87 moves toward the front end, and the engagement portions 876 reach the hole 853 formed in the front side plate 85. At this time, as shown in FIG. 15, the engagement portions 876 fit into the hole 853, and the lower edge of the hole 853 engages the engagement depressions 876*a* of the engagement portions 876. Thus, the slider 87 can be held in an inclined state in which its front end is situated upwards of the upper end of the front side plate 85. In this condition, the rear ends of the first elongate holes 873, 873 are positioned at the first supporting pin 88, while the rear ends of the first parallel portions 874*a* of the second elongate holes 874, 874 are positioned at the second supporting pin 89.

Figure 17:
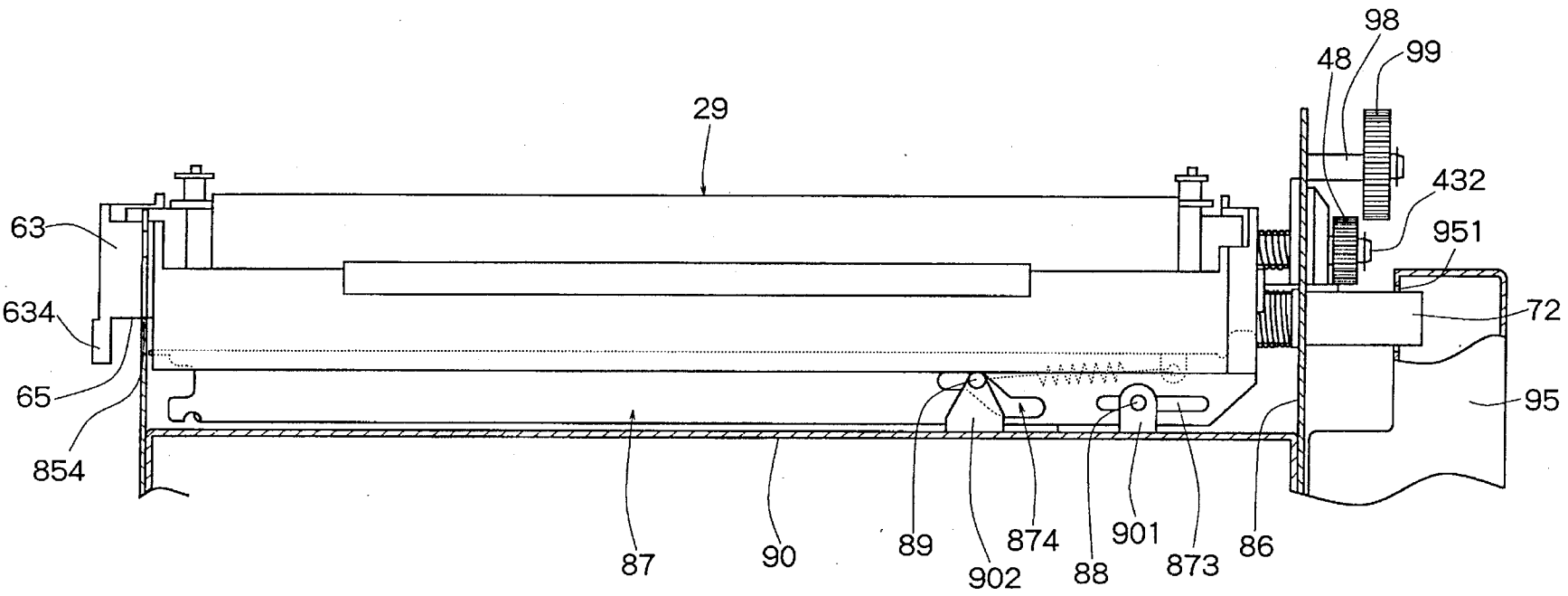
FIG. 17 is a side view showing a state in which the slider and the transfer belt unit have been pushed into the machine body housing after the state of FIG. 16 in which the transfer belt unit is placed on the slider.
Figure 18:
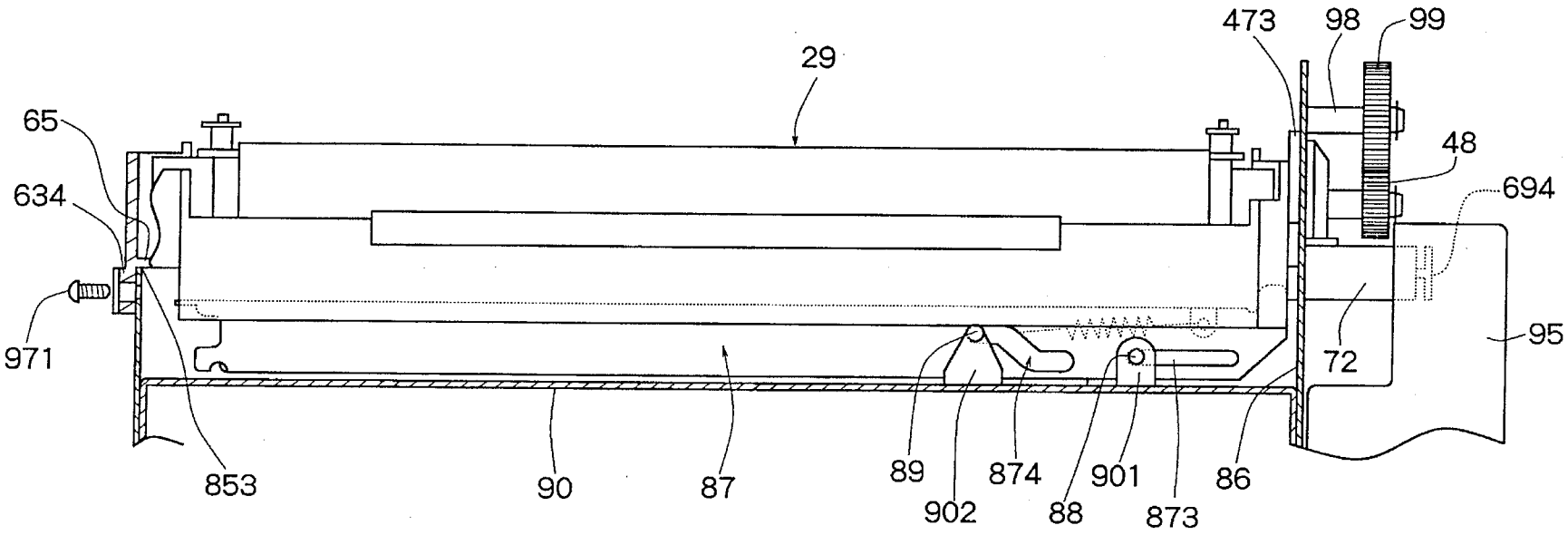
FIG. 18 is a side view showing a state in which the slider and the transfer belt unit have been moved to a predetermined mounting position of the machine body housing after the state of FIG. 17.

The slider mechanism for mounting the transfer belt unit 29 on the clamshell type lower housing 25 is constituted as described above. The procedure of mounting the transfer belt unit 29 will be explained. First, the front end portion of the slider 87 is lifted upwards, and the engagement depressions 876*a* of the engagement portions 876 are engaged with the lower edge of the hole 853 formed in the front side plate 85 to hold the slider 87 in an inclined condition as shown in FIG. 15. In this state, the slide surface 657 of the slide rail 654 formed in the unit housing 60 of the transfer belt unit 29 is placed on the bearing surface 871*a* of the slider 87. As the transfer belt unit 29 is moved along the bearing surface 871*a* of the slider 87 as far as the position illustrated in FIG. 16, the rear end of the slide rail 654 contacts the stoppers 875, 875 provided at the rear end of the slider 87. The engagement hole 633 formed in the front side wall 63 of the unit housing 60 engages the engagement portion 877 provided in the slider 87, whereby the transfer belt unit 29 and the slider 87 are integrated. At this time, the driven gear 48 mounted on the driving roller 43 of the transfer belt unit 29 has passed through the hole 861 formed in the rear side plate 86, and the guide portion 471 of the position restricting member 47 contacts the upper edge portion of the hole 861. Also, the blocking cylinder 72 fitted over the guide cylinder 693 of the toner carriage member 69 has been inserted into the hole 862 formed in the rear side plate 86. When the transfer belt unit 29 and the slider 87 are pushed rearward from the state of FIG. 16, the engagement portion 876 and the hole 853 are disengaged. Thus, the transfer belt unit 29 and the slider 87 are turned downward about the first supporting pin 88 and guided along the second elongate holes 874, 874 where the second supporting pin 89 has been inserted. When they come to a nearly horizontal condition as illustrated in FIG. 17, the bottom wall 65 aligning with the position of the mounting portion 634 of the front side wall 63 contacts a bottom edge 854 of the notched portion 852 formed in the front side plate 85. At this time, the position restricting member 47 is positioned because its guide portion 471, having a conical surface, is guided, and its fitting portion 472 is fitted into the hole 861 formed in the rear side plate 86. At the same time, the flange portion 473 contacts the rear side plate 86. The blocking cylinder 72 fitted over the guide cylinder 693 of the toner carriage member 69 is inserted into a hole 951 provided in a waste toner box 95 disposed behind the rear side plate 86, and the flange 722 contacts the rear side plate 86. A smaller-diameter portion between the detachable member 46 mounted at the front end portion of the driving roller 43 and the gear 45 is fitted into the circular supporting hole 851, formed in the front side plate 85, from its upper opening. When the transfer belt unit 29 and the slider 87 are further pushed rearward from the state of FIG. 17, the mounting portion 634 contacts the front side plate 85 as shown in FIG. 18. At this time, the positioning hole 635 formed in the mounting portion 634 fits over a positioning pin 96 provided in the front side plate 85 as shown in FIG. 12. The detachable member 46 is guided on the conical surface of the guide portion 463 constituting the position restricting means 465, and moved in the circular supporting hole 851. The fitting portion 464 is fitted into the circular supporting hole 851 for positional restriction. In this condition, as illustrated in FIG. 12, a mounting bolt 971 is inserted into the hole 636 for passage of a mounting bolt that is formed in the mounting portion 634, and is screwed into a threaded hole formed in the front side plate 85. Simultaneously, mounting bolts 972 and 973 are inserted into the holes 461 and 462 for passage of mounting bolts that are formed in the detachable member 46, and is screwed into threaded holes formed in the front side plate 85. Thereby the transfer belt unit 29 can be mounted and fixed on the clamshell type lower housing 25. On the rear side of the transfer belt unit 29, the driven gear 48 mounted on the driving roller 43 is mounted rotatably on a short shaft 98, attached to the rear side plate 86, and is meshed with a transmission gear 99 transmittingly connected to a driving gear (not shown). In the blocking cylinder 72 fitted over the guide cylinder 693 of the toner carriage member 69, the front end portion of the guide cylinder 693 protrudes from the blocking cylinder 72 into the waste toner box 95, since the flange 722 pressed against the rear side plate 86 is immobile, but the guide cylinder 693 moves. Thus, waste toner carried by the toner carriage member 69 can be discharged. To detach the transfer belt unit 29, mounted on the lower housing 25 this way, for replacement of parts and so forth, a procedure reverse to the above-described mounting procedure is performed, whereby detachment can be carried out easily.

Figure 19:
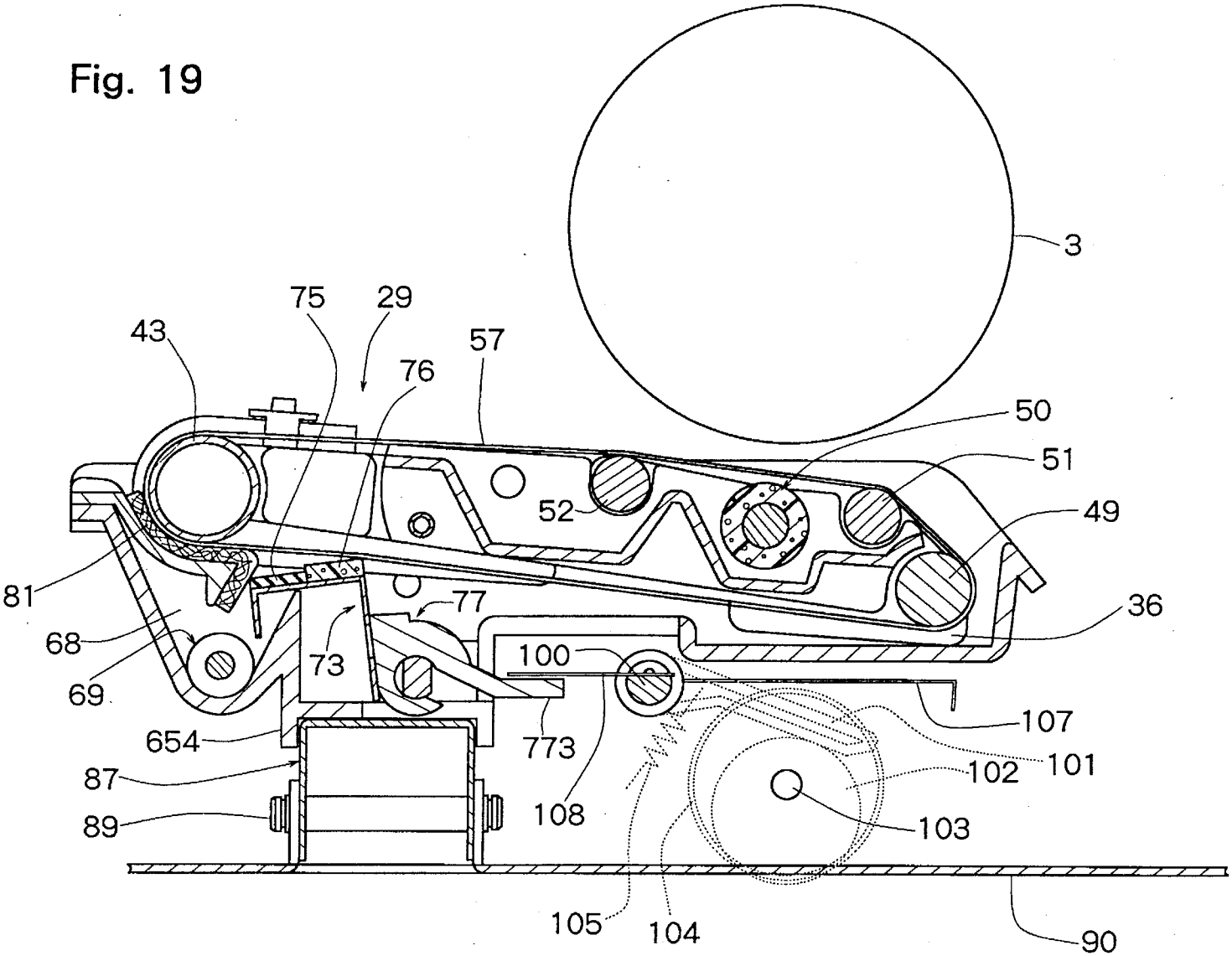
FIG. 19 is a sectional view of the transfer device mounted on the machine body housing.
Figure 20:
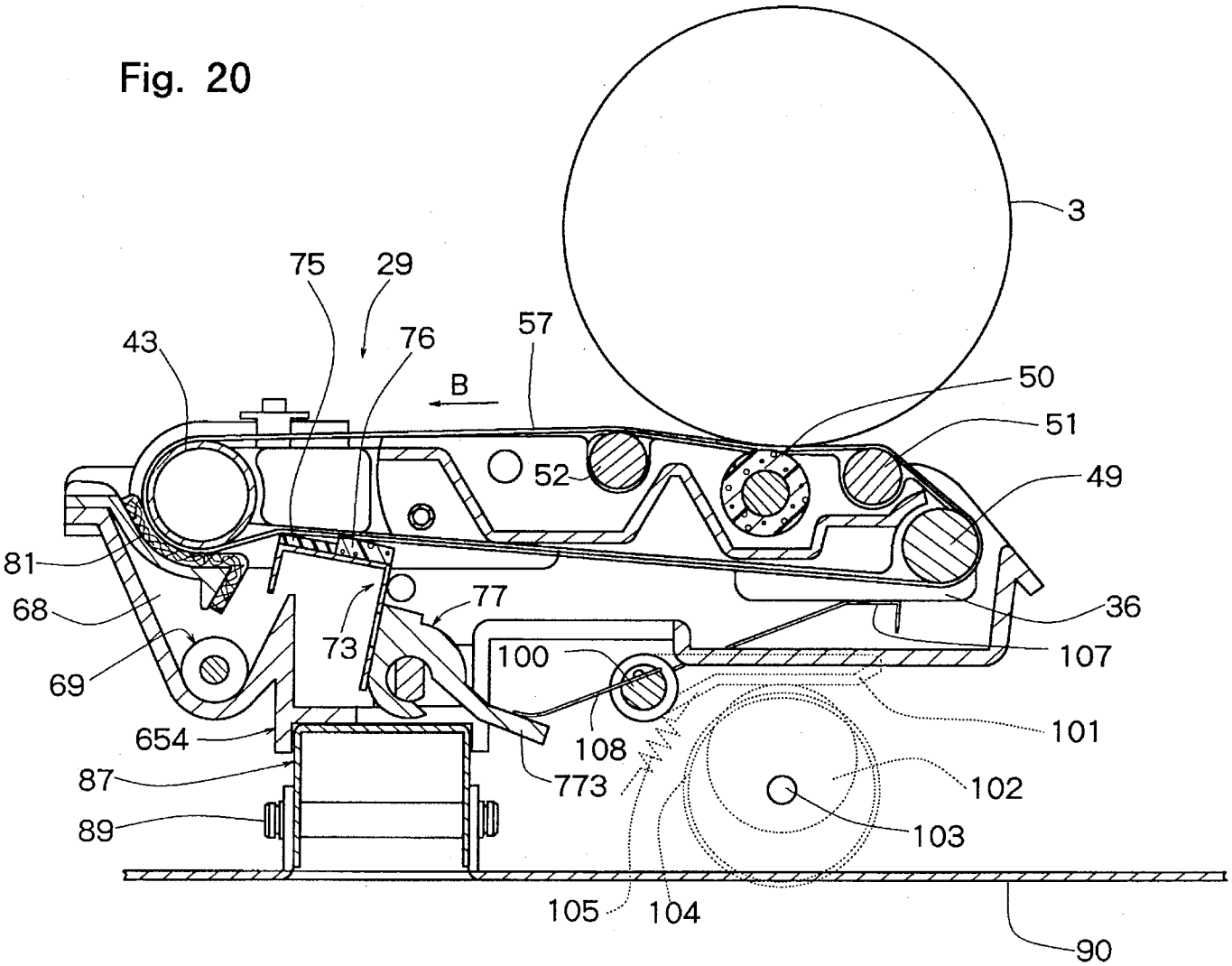
FIG. 20 is a sectional view showing the transfer device mounted on the machine body housing and brought to a transfer state.

The positional relationship between the image bearing member 3 and the transfer belt unit 29 mounted on the lower housing 25 constituting the clamshell type machine body housing is shown in FIG. 19. The transfer roller 50 of the transfer belt unit 29 is positioned nearly directly below the image bearing member 3, and there is a gap between the transfer belt 57 and the image bearing member 3. There is also a 1.00 to 2.00 mm gap between the transfer belt 57 and the transfer roller 50. Thus, the belt unit 30 of the transfer belt unit 29 mounted on the lower housing 25 constituting the machine body housing is rotated upwards about the driving roller 43 by a contacting/separating means (to be described later) at the time of transfer, and brought to a transfer position. As shown in FIG. 20, the transfer belt 57 is contacted with the outer peripheral surface of the image bearing member 3, and it is also pressed by the transfer roller 50. Hereinbelow, the contacting/separating means will be described mainly with reference to FIGS. 11, 19 and 20.

The contacting/separating means has an operating shaft 100 which is disposed in the back-and-forth direction above the base plate 87 on the lower housing 25 and supported rotatably on the front side plate 85 and the rear side plate 86. At the rear end portion of the operating shaft 100 is attached a lever 101 which is caused to act by a cam to be described later. A cam 102 causing the lever 101 to act is mounted on a rotating shaft 103 journaled rotatably on the front side plate 85. A coiled tension spring 105 is mounted between the lever 101 and the front side plate 85, so that the lever 101 is in constant contact with the outer peripheral surface of the cam 102. On the rotating shaft 103 is mounted a driven gear 104, which is transmissibly connected to a driving gear (not shown). Hence, when the driven gear 104 is rotationally driven, the lever 101 in contact with the outer peripheral surface of the cam 102 is revolved in a predetermined angular range by the action of the cam 102, thereby reciprocatingly turning the operating shaft 100 in a predetermined angular range. On the operating shaft 100 are mounted contacting/separating operating levers 106 and 107, formed of a spring steel, at positions slightly away from the front and rear side plates 85 and 86 and toward the center. These contacting/separating operating levers 106 and 107 are placed at positions aligning with the openings 652 and 653 formed in the bottom wall 65 of the unit housing 60 of the transfer belt unit 29 mounted on the lower housing 25. At the center of the operating shaft 100 is mounted an operating lever 108 for cleaning which is formed of a spring steel and which is to contact the top of an operated lever 773 formed in the mounting portion 77 for mounting the holder 74 where the cleaning blade 75 and the paper dust removing member 76 are mounted. The operated lever 773, the operating lever 108 for cleaning, the operating shaft 100, and the lever 101 and the cam 102 constitute an operating mechanism for causing the holder 74, where the cleaning blade 75 and the paper dust removing member 76 are mounted, to act in correspondence with the direction of operation of the belt unit 60 by the contacting/separating means. This operating mechanism is actuated by a drive source common to the contacting/separating means.

The transfer device of the image forming machine according to the illustrated embodiment is constituted as noted above. Its actions will be described below. When the image forming machine is actuated from the state of the transfer belt unit 29 mounted on the lower housing 25 in the above manner (FIG. 19), the driven gear 104 is rotationally driven by a driving unit (not shown). Since the driven gear 104 is rotationally driven, the cam 102 is also rotated, and when it reaches the transfer position shown in FIG. 20, it is stopped. As the cam 102 pivots to the transfer position shown in FIG. 20, the lever 101 in contact with the outer peripheral surface of the cam 102 is swayed upwards to pivot the operating shaft 100 counterclockwise in FIG. 20. Thus, the operating levers 106 and 107 for contact and separation which are mounted on the operating shaft 100 are moved upwards to contact the undersides of the supporting plates 35 and 36 constituting the belt unit 30, thereby pushing the belt unit 30 pivotally upwards about the driving roller 43. As a result, the transfer belt 57 is pressed against the image bearing member 3, and the transfer roller 50 is also pressed against the transfer belt 57. By this contact under pressure, the roller portion of the transfer roller 50 is compressed by about 0.5 to 1.0 mm, and thus the transfer belt 57 can uniformly contact with the image bearing member 3 under a predetermined pressure. On the other hand, the operating lever 108 for cleaning that is mounted on the operating shaft 100 is moved downwards. Thus, the mounting member 77 equipped with the operated lever 773 in contact with the operating lever 108 is pivoted clockwise in FIG. 20 about the supporting shaft 78. Consequently, the holder 74, having the mounting member 77 mounted thereon, is actuated to the position shown in FIG. 20, so that the edge portion of the cleaning blade 75 mounted on the holder 74 is pressed against the transfer belt 57. Also, that edge portion of the paper dust removing member 76, mounted likewise on the holder 74, which on the cleaning blade 75 side is contacts the transfer belt 57.

Next, when the driven gear 48 is rotationally driven via the transmission gear 99 transmissibly connected to the driving unit (not shown), the driving roller 43 having the driven gear 48 mounted thereon is rotated. Upon its rotation, the transfer belt 57 is actuated in the direction of arrow B. Also, with the rotation of the driving roller 43, the driven gear 70 is rotated via the gear 45 mounted on the driving roller 43 and the intermediate gear 71. When the driven gear 70 is rotated, the toner carriage member 69 having the driven gear 70 mounted thereon is rotated. Separately, the transfer roller 50 receives a predetermined voltage from the voltage applying means 200 (see FIG. 1). Via the transfer roller 50, a charge of a predetermined polarity is imposed on the transfer belt 57. Therefore, when a transfer paper is fed between the image bearing member 3 and the transfer belt 57, a toner image formed on the surface of the image bearing member 3 is sequentially attracted and transferred to the transfer paper by the action of the charge applied to the transfer belt 57 at the transfer portion where the image bearing member 3 and the transfer belt 57 face each other. The transfer paper having the toner image transferred thereto is conveyed by the transfer belt 57, has the toner image fixed by the fixing roller pair 23, and is discharged from the discharge roller pair 24. The toner adhered to the surface of the transfer belt 57 is scraped off by the cleaning blade 75 during travel in the direction of arrow B and caused to fall into the waste toner accommodating portion 68. The toner dropped there is carried rearwards by the toner carriage member 69, and discharged into the waste toner box 95 from the front end of the guide cylinder 693.

Then, at a time of non-transfer, the driving roller 43 is stopped, and the voltage applied to the transfer roller 50 is shut off. The driven gear 104 is rotationally driven by the driving unit (not shown) to bring the cam 102 to the position shown in FIG. 19. As the cam 102 pivots to the position shown in FIG. 19, the lever 101 in contact with the outer peripheral surface of the cam 102 is moved downwards to pivot the operating shaft 100 clockwise in FIG. 19. Thus, the operating levers 106 and 107 for contact and separation which are mounted on the operating shaft 100 are moved downwards. Hence, the belt unit 30 is pivoted downwards about the driving roller 43, whereupon the supporting plates 35 and 36 contact the bottom wall 65 of the unit housing 60, returning to the non-transfer position shown in FIG. 19. That is, the image bearing member 3 and the transfer belt 57, as well as the transfer belt 57 and the transfer roller 50 are separated from each other. This can prevent the deformation of the transfer roller 50 arising from constant contact of the transfer roller 50 with the transfer belt 57. On the other hand, the operating lever 108 for cleaning that is mounted on the operating shaft 100 is moved upwards. Thus, the mounting member 77 equipped with the operated lever 773 in contact with the operating lever 108 is pivoted counterclockwise in FIG. 19 about the supporting shaft 78. Consequently, the holder 74 having the mounting member 77 mounted thereon is returned to the position shown in FIG. 19, so that the cleaning blade 75 mounted on the holder 74 separates from the transfer belt 57. This can prevent the deformation of the transfer belt 57 arising from constant contact of the cleaning blade 75 with the transfer belt 57. In this condition as well, that edge portion of the paper dust removing member 76 mounted likewise on the holder 74 which is opposite to the cleaning blade 75 side is in contact with the transfer belt 57. Since the paper dust removing member 76 is in constant contact with the transfer belt 57, the toner remaining adhered at the position of contact of the cleaning blade 75 with the transfer belt 57 at the time of separation of the belt unit 30 is smoothed by the paper dust removing member 76 even if the toner moves under the inertia of the transfer belt during a period until its stoppage. At the next transfer, therefore, toner build-up adhered to the transfer belt can be prevented from falling into the machine.

[Example 1]

Tests were conducted of various transfer rollers 50 produced with the outside diameter of the rotating shaft 501 of the transfer roller being 8 mm, the outside diameter of the roller portion 502 mounted on the rotating shaft being 16 mm, and the roller portion being made of urethane foam with a varying hardness. The volume resistivity of the roller portion of the transfer roller was set at $10^5$ ohm-centimeters, the volume resistivity of the transfer belt at $10^{11}$ Ωcm, and the voltage applied to the transfer roller at 2.5 kV. The tests gave the following findings: When the hardness of the roller portion resulted in a compression of less than 0.45 mm at a linear pressure of 3 g/cm, the partial missing phenomenon occurred during transfer to an OHP film; whereas when the hardness of the roller portion was lower, no partial missing phenomenon occurred. However, when the hardness of the roller portion was low enough to result in a compression of greater than 2.00 mm at a linear pressure of 3 g/cm, a predetermined frictional force was not obtained, making free-running with the transfer belt difficult. Also, a shearing force developing between the transfer belt and the roller portion damaged the surface of the roller portion. It was thus found that the hardness of the roller portion of the transfer roller should desirably be set to result in a compression of 0.45 to 2.00 mm at a linear pressure of 3 g/cm. By so doing, it becomes possible to ensure durability without causing the partial missing phenomenon, even when a transfer paper, to which a toner adheres with difficulty, such as an OHP film, is used.

[Example 2]

Figure 22A:
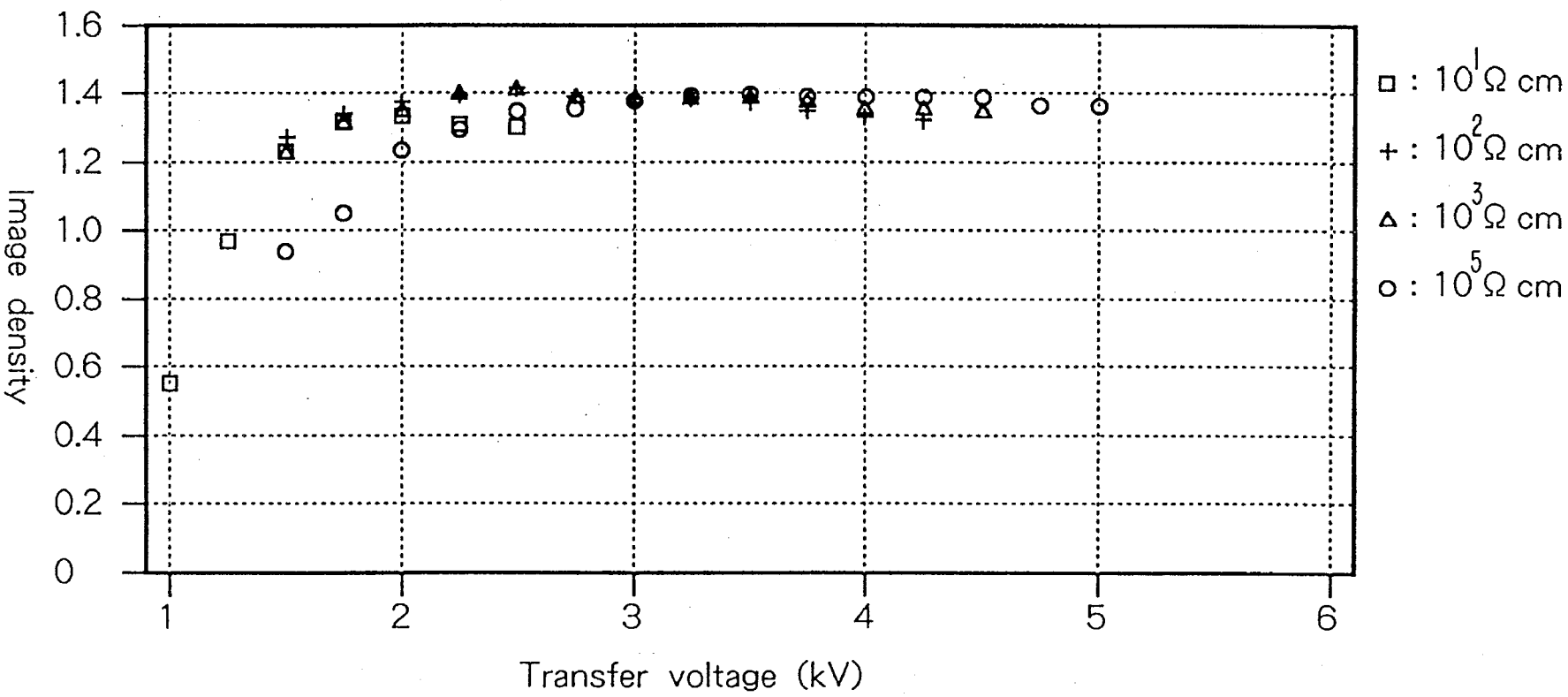
FIG. 22 shows the image densities relative to the transfer voltages on the transfer rollers with volume resistivities of $10^1$, $10^2$, $10^3$ and $10^5$ ohm-centimeters, in which FIG. 22(*a*) gives the values in a low temperature, low humidity (L/L) environment, FIG. 22(*b*) gives the values in a normal temperature, normal humidity (N/N) environment, and FIG. 22(*c*) gives the values in a high temperature, high humidity (H/H) environment.
Figure 22B:
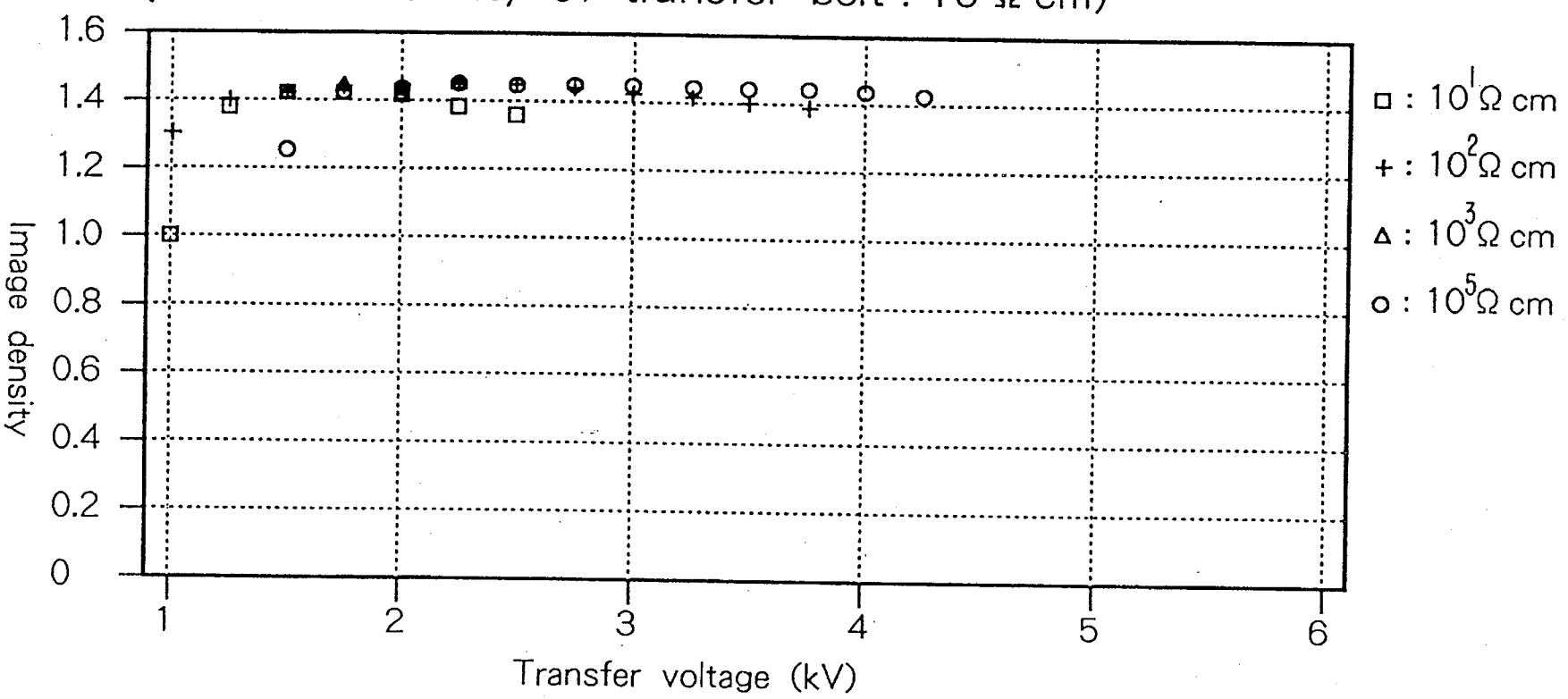
Figure 22C:
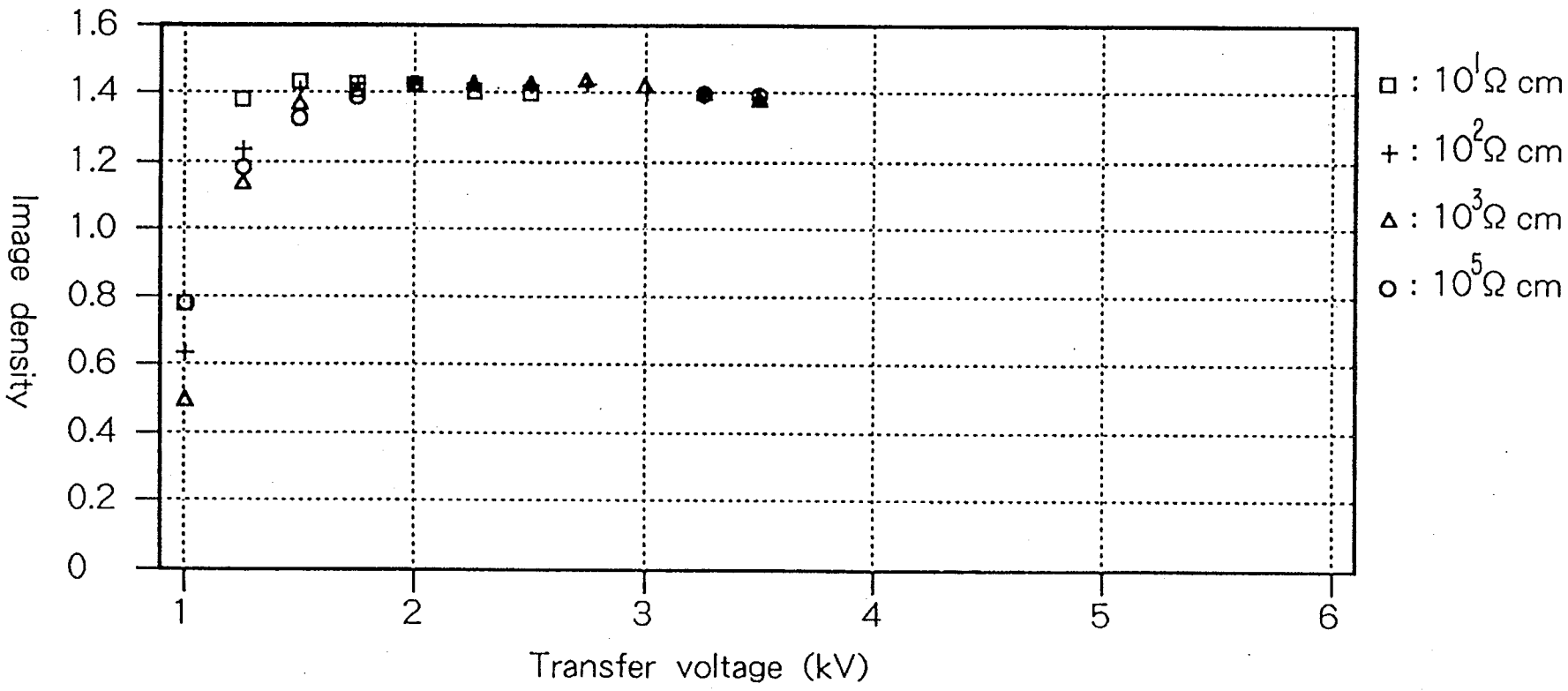
Figure 23B:
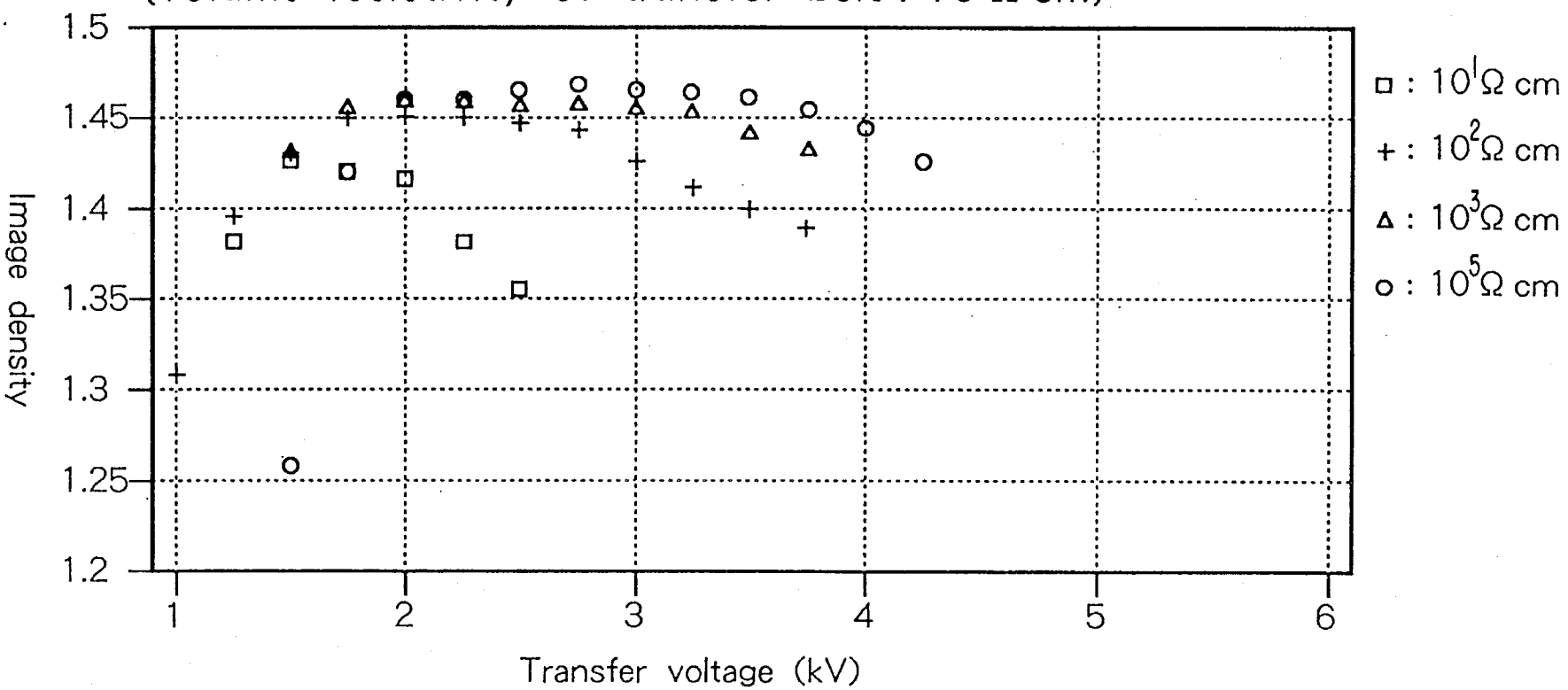
FIG. 23 is views showing the image densities of FIG. 22 (ordinates) in varied ranges.
Figure 23C:
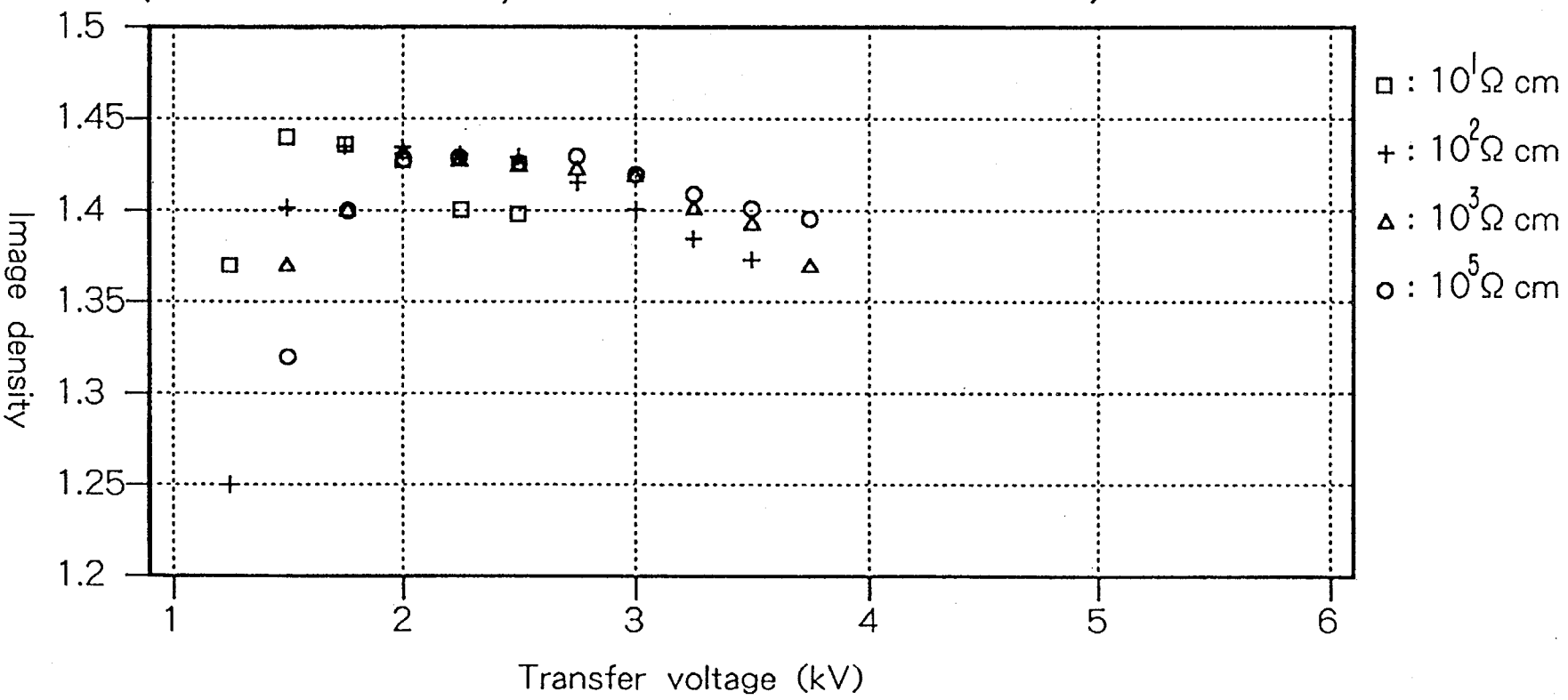
Figure 24A:
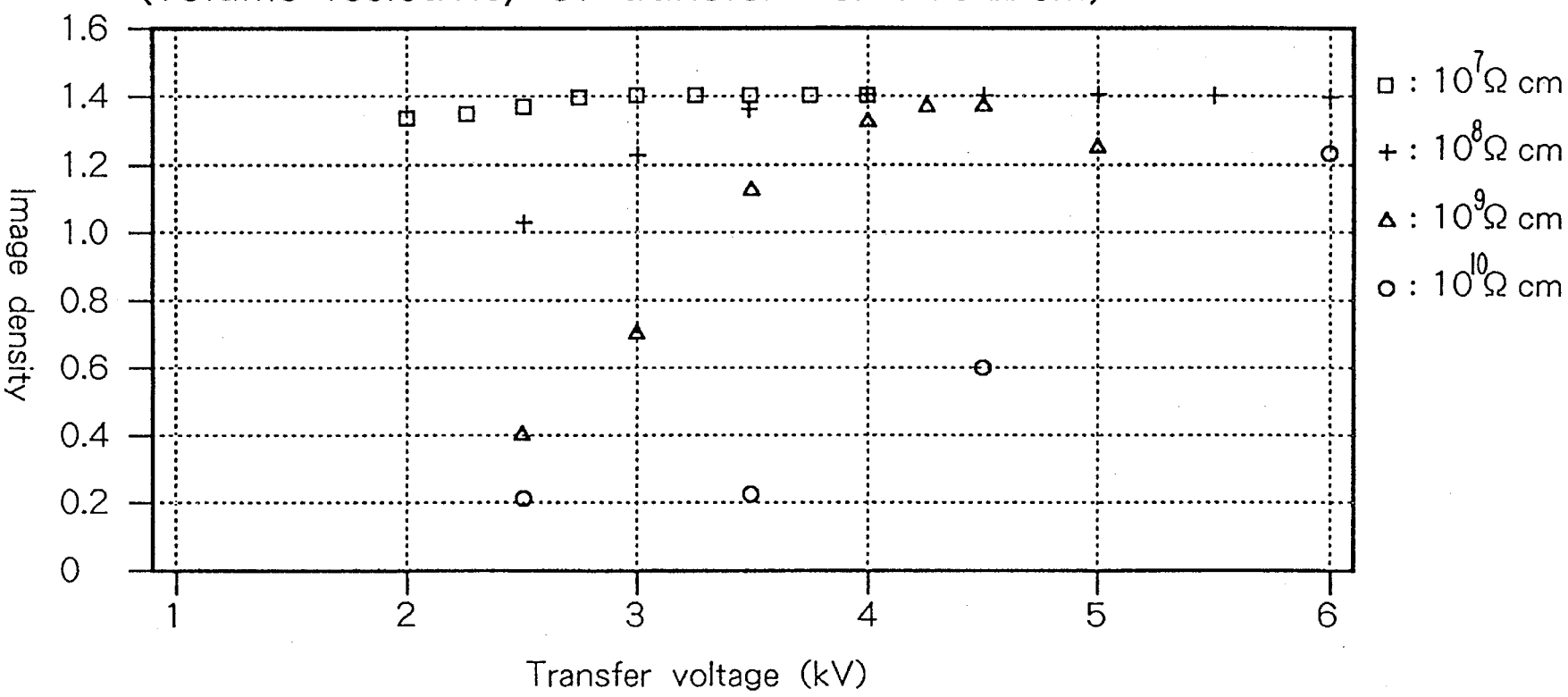
FIG. 24 shows the image densities relative to the transfer voltages on the transfer rollers with volume resistivities of $10^7$, $10^8$, $10^9$ and $10^{10}$ ohm-centimeters, in which FIG. 24(*a*) gives the values in a low temperature, low humidity (L/L) environment, FIG. 24(*b*) gives the values in a normal temperature, normal humidity (N/N) environment, and FIG. 24(*c*) gives the values in a high temperature, high humidity (H/H) environment.
Figure 24B:
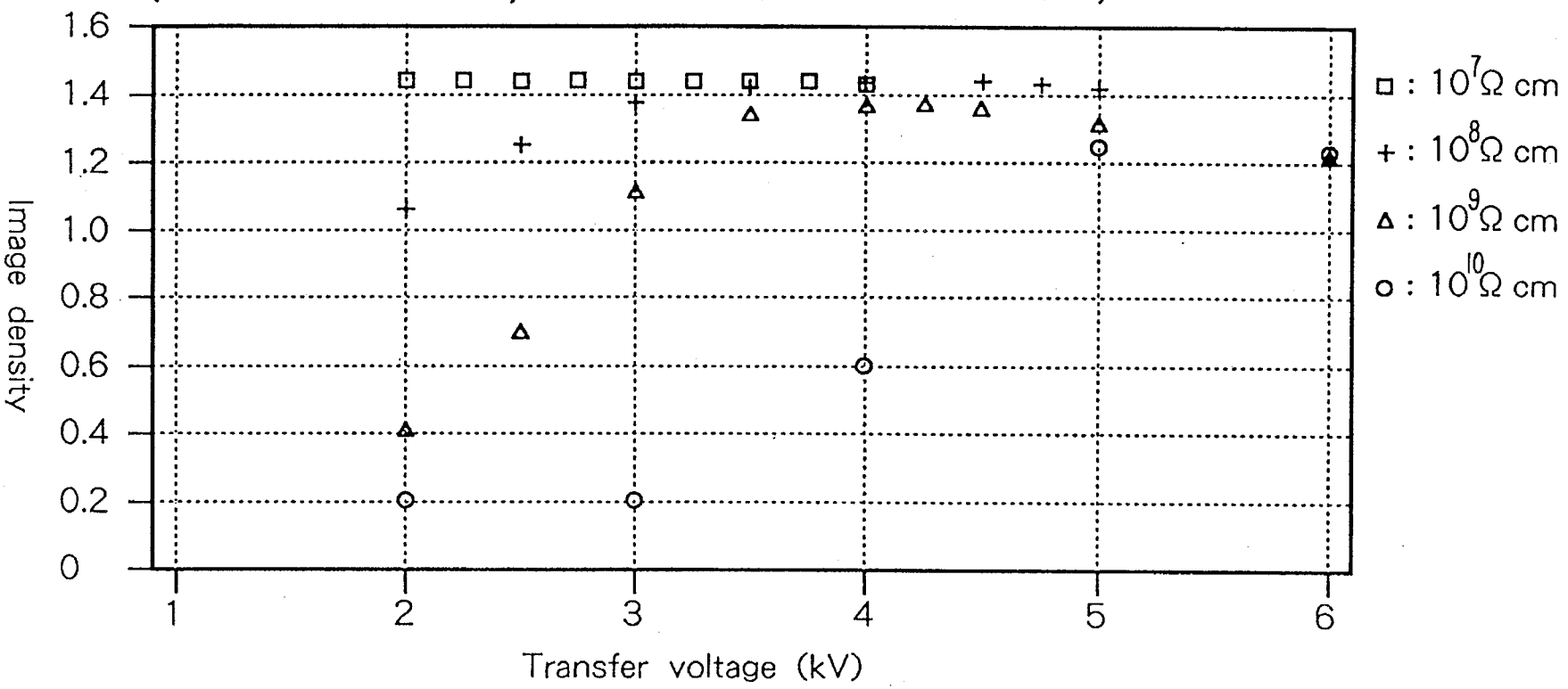
Figure 24C:
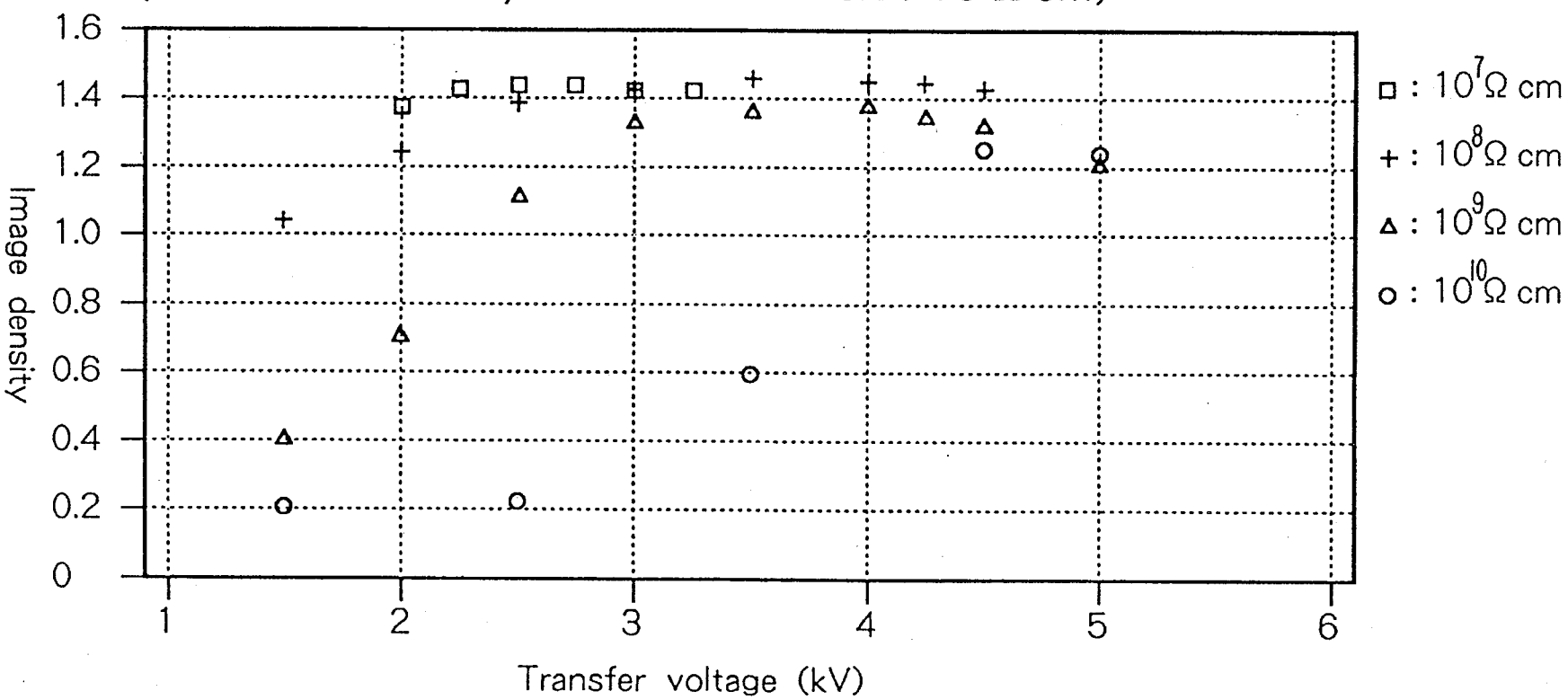
Figure 25A:
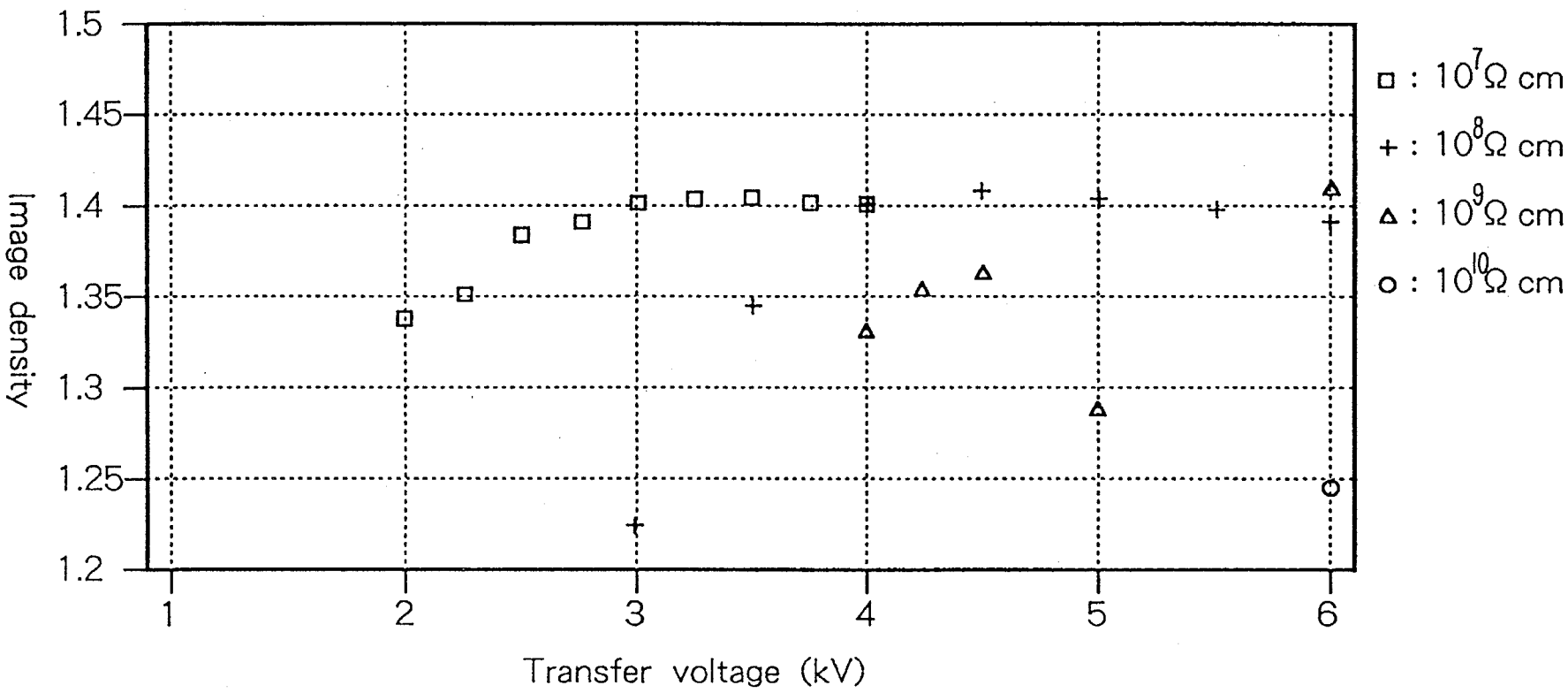
FIG. 25 is views showing the image densities of FIG. 24 (ordinates) in varied ranges.
Figure 25B:
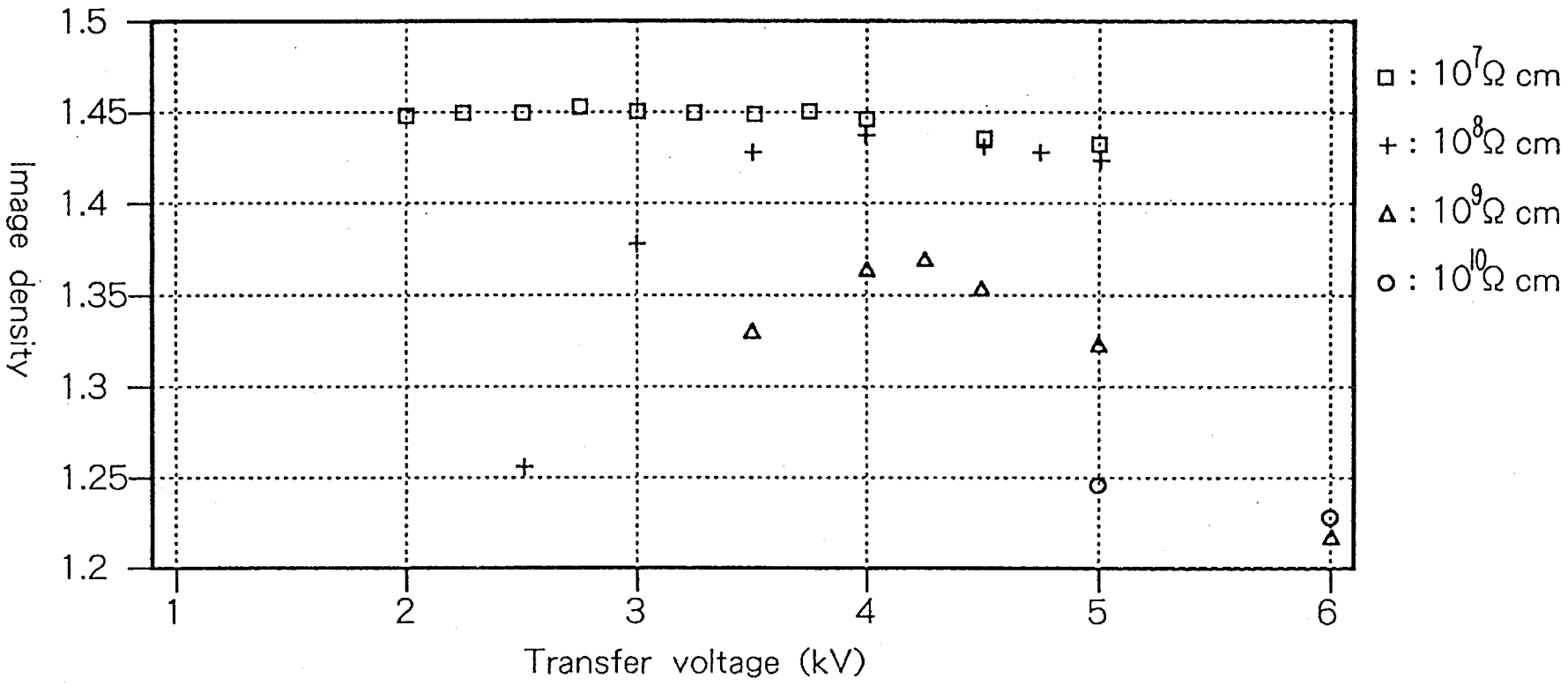
Figure 25C:
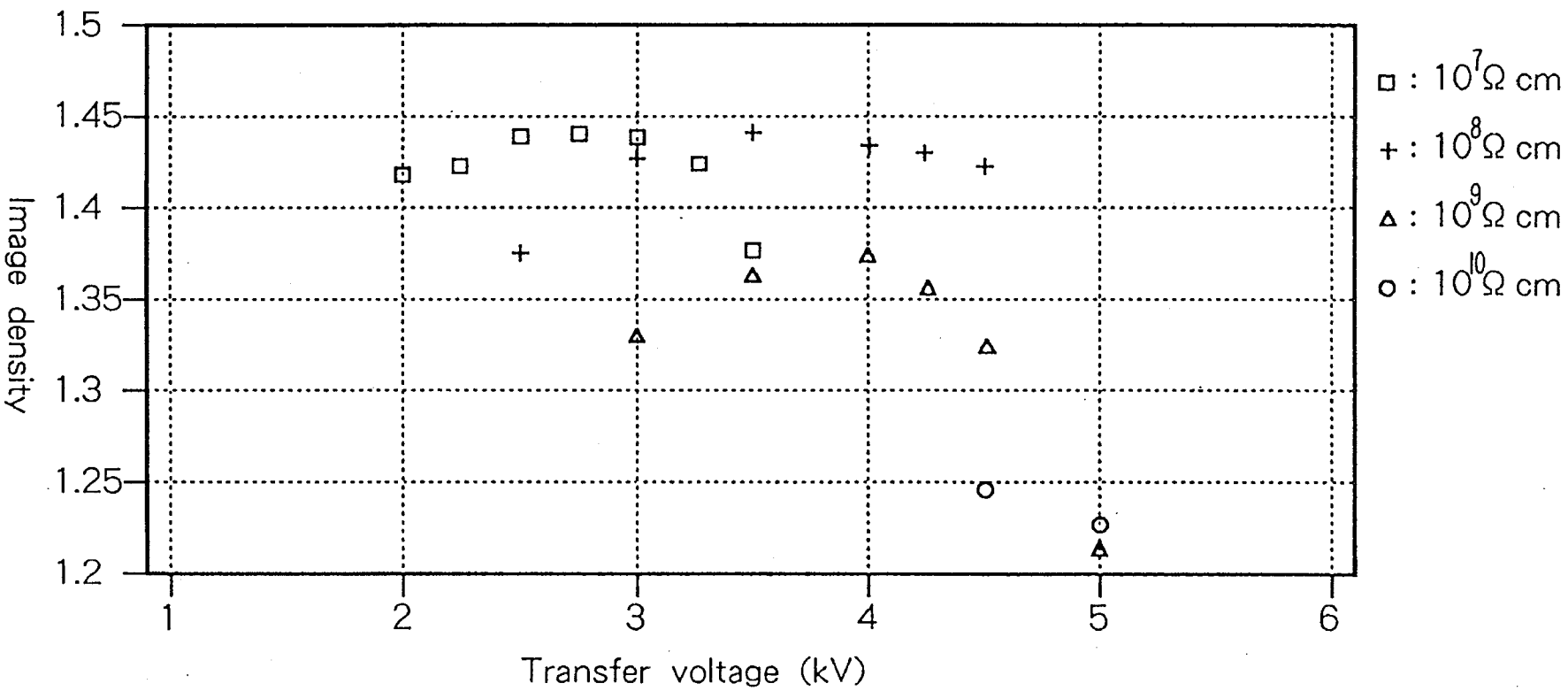

Experiments were conducted of various transfer rollers 50 produced with the outside diameter of the rotating shaft 501 of the transfer roller being 8 mm, the outside diameter of the roller portion 502 mounted on the rotating shaft being 16 mm, and the roller portion having a varying volume resistivity. The transfer belt had a volume resistivity of $10^{11}$ ohm-centimeters. The results of the experiments are shown in FIGS. 22 to 25. FIG. 22 shows the image densities relative to the transfer voltages on the transfer rollers with volume resistivities of $10^1$, $10^2$, $10^3$ and $10^5$ ohm-centimeters, in which FIG. 22(*a*) gives the values in a low temperature (10° C.), low humidity (15%) (L/L) environment, FIG. 22(*b*) gives the values in a normal temperature (20° C.), normal humidity (65%) (N/N) environment, and FIG. 22(*c*) gives the values in a high temperature (35° C.), high humidity (85%) (H/H) environment. FIGS. 23(*a*), 23(*b*) and 23(*c*) show the image densities (ordinates) of FIGS. 22(*a*), 22(*b*) and 22(*c*), respectively, in varied ranges. FIG. 24 shows the image densities relative to the transfer voltages on the transfer rollers with volume resistivities of $10^7$, $10^8$, $10^9$ and $10^{10}$ ohm-centimeters, in which FIG. 24(*a*) gives the values in a low temperature (10° C.), low humidity (15%) (L/L) environment, FIG. 24(*b*) gives the values in a normal temperature (20° C.), normal humidity (65%) (N/N) environment, and FIG. 24(*c*) gives the values in a high temperature (35° C.), high humidity (85%) (H/H) environment. FIGS. 25(*a*), 25(*b*) and 25(*c*) show the image densities (ordinates) of FIGS. 24(*a*), 24(*b*) and 24(*c*), respectively, in varied ranges. The experimental results shown in FIGS. 22 to 25 demonstrate the following:

(1) As a general tendency, the higher the volume resistivity of the transfer roller, the higher the transfer voltage should be made. When the volume resistivity of the transfer roller is high, the stable range of the image density (the peak zone) widens with respect to changes in the transfer voltage. In the high temperature, high humidity (H/H) environment, the stable range is obtained at lower transfer voltages than in the low temperature, low humidity (L/L) environment.

(2) The image density should desirably be 1.35 or more. If the necessary image density is assumed to be at least 1.35, all transfer rollers give images with image densities of 1.35 or more in the normal temperature, normal humidity (N/N) environment and in the high temperature, high humidity (H/H) environment. In the low temperature, low humidity (L/L) environment shown in FIG. 23(*a*), the transfer roller with a volume resistivity of $10^1$ ohm-centimeters cannot give images with an image density of 1.35. This may be because of the partial missing phenomenon occurring before complete transfer takes place. In order to obtain a desirable image density, one will see that the volume resistivity of the transfer roller should be $10^2$ ohm-centimeters or more.

(3) When the transfer device is mounted on the image forming machine, the desirable transfer voltage should be as low as possible from the point of view of power consumption and for safety reasons (a higher transfer voltage may be dangerous because of a possible current leakage). Assume that a feasible transfer voltage is at most 5 kV. As shown in FIGS. 24(*a*), 24(*b*) and 24(*c*), the transfer rollers with volume resistivities of $10^9$ ohm-centimeters or less give a stable range of image densities of 1.35 or more at transfer voltages of 5 kV or less. The transfer rollers with a volume resistivity of $10^{10}$ ohm-centimeters require transfer voltages of 6 kV or more in all environments. Thus, in view of the feasible transfer voltage, the volume resistivity of the transfer roller needs to be $10^9$ ohm-centimeters or less.

Based on the above experimental results, the volume resistivity of the transfer roller should desirably be set in the range of from $10^2$ ohm-centimeters to $10^9$ ohm-centimeters, considering the feasible transfer voltage from the viewpoints of the desirable image density, economical power consumption, and high safety. For example, if the transfer roller with a volume resistivity of $10^2$ ohm-centimeters is selected, the transfer voltage should be set at 2 to 3.5 kV. By so doing, an image with an image density of 1.35 or more can be always obtained without the need to control the transfer voltage in accordance with the environmental conditions. If the transfer roller with a volume resistivity of $10^5$ ohm-centimeters is selected, it is advisable to set the transfer voltage at 2.75 to 4 kV. If the transfer roller with a volume resistivity of $10^8$ ohm-centimeters is selected, the transfer voltage should be set at 3.75 to 5 kV. In the case of the transfer roller with a volume resistivity of $10^9$ ohm-centimeters, the scope of selecting the transfer voltage is narrow. By setting the transfer voltage at 4.25 kV, however, an image density of approximately 1.35 can be secured. Hence, if the volume resistivity of the roller portion of the transfer roller is set at $10^2$ ohm-centimeters to $10^9$ ohm-centimeters, a predetermined image density can be obtained without controlling the transfer voltage in accordance with the environmental conditions, by setting the transfer voltage in a safely usable range suitable for the volume resistivity of the transfer roller selected. Moreover, the transfer voltage applied to the transfer roller can be set at 5 kV or less, so that safety can be ensured with less power consumption.

What we claim is:

1. A transfer device for an image forming machine, comprising a driving roller, a driven roller disposed at a distance from said driving roller, a transfer belt looped about said driving roller and said driven roller, a transfer roller adapted to be disposed opposite an image bearing member of the image forming machine with said transfer belt interposed therebetween and with said transfer roller pressing said transfer belt against the image bearing member, and a voltage source for applying a predetermined voltage onto said transfer roller to transfer a toner image, formed on the surface of the image bearing member, to a transfer paper fed between said transfer belt and the image bearing member, and to convey the transfer paper with the toner image transferred thereon, wherein said transfer roller consists of a rotating shaft and a roller portion mounted on said rotating shaft, and the hardness of said roller portion results in a compression of said roller portion of 0.45 to 2.00 mm at a linear pressure of 3 g/cm.

2. The transfer device of claim 1, wherein the roller portion of the transfer roller comprises a foam impregnated with a conductive substance.

3. The transfer device of claim 1, wherein said roller portion of said transfer roller has a volume resistivity in the range of $10^2$ to $10^9$ ohm-centimeters.

* * * * *